US007818831B2

(12) United States Patent
Mahdjoubi

(10) Patent No.: US 7,818,831 B2
(45) Date of Patent: Oct. 26, 2010

(54) MULTI-PURPOSE HOSPITAL BED

(76) Inventor: Mohammad Hassan Mahdjoubi, 22 Constantinou Katerou St., Engomi, Nicisia (CY) 2402

( * ) Notice: Subject to any disclaimer, the term of this patent is extended or adjusted under 35 U.S.C. 154(b) by 767 days.

(21) Appl. No.: 11/309,498

(22) Filed: Aug. 14, 2006

(65) Prior Publication Data

US 2009/0013462 A1 Jan. 15, 2009

(51) Int. Cl.
*A61G 5/00* (2006.01)

(52) U.S. Cl. ..... 5/81.1 R; 5/613; 5/710

(58) Field of Classification Search ..... 5/81.1 R, 5/89.1, 607, 480, 613, 715, 640, 691, 657, 5/728, 722, 705, 612

See application file for complete search history.

(56) References Cited

U.S. PATENT DOCUMENTS

| | | | | |
|---|---|---|---|---|
| 1,857,031 | A * | 5/1932 | Schaffer | 5/86.1 |
| 3,945,063 | A * | 3/1976 | Matsuura | 5/611 |
| 4,038,709 | A | 8/1977 | Kerwit | |
| 4,638,519 | A | 1/1987 | Hess | |
| 4,669,136 | A | 6/1987 | Waters et al. | |
| 4,953,244 | A | 9/1990 | Koerber, Sr. et al. | |
| 5,323,498 | A * | 6/1994 | Fellay et al. | 5/86.1 |
| 5,428,851 | A * | 7/1995 | Shore et al. | 5/87.1 |
| 6,799,342 | B1 * | 10/2004 | Jarmon | 5/613 |
| 7,171,711 | B2 * | 2/2007 | Gowda | 5/713 |
| 2007/0028381 | A1 * | 2/2007 | Palay et al. | 5/81.1 R |

* cited by examiner

*Primary Examiner*—Robert G Santos
*Assistant Examiner*—Brittany M Wilson
(74) *Attorney, Agent, or Firm*—Barry Choobin; Aryan Patent Chobin & Chobin

(57) ABSTRACT

Disclosed is a method for transferring a patient from a first bed to a second bed, wherein said patient is disposed upon said first bed and said first bed and second bed comprise a surface for resting said patient comprising a plurality of predetermined sections. The method further discloses removing at least one of said plurality of predetermined sections of said surface of said first bed and replacing it with at least one of said plurality of predetermined sections of said surface of said second bed and removing at least one of said plurality of predetermined sections of said surface of said second bed and replacing it with at least one of said plurality of predetermined sections of said surface of said first bed; combining said surface of said first bed with said surface of said second bed; and transferring said patient from said first bed to second bed.

24 Claims, 46 Drawing Sheets

25
28
31
30
16
23
26
24
27

36

44
47

43
49
50
50
48
50
50
45
46

MULTI-PURPOSE HOSPITAL BED

FIELD OF THE INVENTION

The present invention relates to a transfer and transport system for immobile prone patients in addition to having the means to facilitate air flow under a patient's back for the prevention of bed sores. Another beneficial object of the invention refers to the means whereby linen on a patient's support surface is conveniently changed with ease and without the necessity of moving the patient.

BACKGROUND OF THE INVENTION

All medical facilities have part of their routine the constant transfer of patients from one support surface such as a permanently-placed hospital bed to another support surface such as another bed, a gurney or any other maneuverable support surface. This is inevitable because of the need for patients to be moved to other sections of the medical facility for surgery, further medical tests, x-rays and scans, the soaking of burn victims in water tubs, and etc. The transfer can be very uncomfortable and painful for the patients and may require a number of medical personnel to facilitate the transfer especially with immobile and heavy patients.

Depending on how advanced facilities in a medical establishment are, non-ambulatory patients are moved in various ways. Often, several personnel are required to lift the patient at one time from one bed to another, usually a wheeled contraption, or to a wheelchair before being transported to another section of the medical facility. This leads to work-related complaints from nurses and medical attendants because of back injuries incurred.

Innovations have been attempted to facilitate the easy transfer and transport of immobile and critically-ill patients. Hoist-type lifts wherein patients are suspended in a sling have been used but this entails positioning the sling under the patient first then physically lifting the patient which results in the change of the patient's body position and the application of pressure points other than those applied when in a prone position. This can be very uncomfortable for patients, particularly orthopedic and burn patients. A similar system is the use of roller boards which, again, have to be positioned under a patient before transport and yet may not be able to securely keep the patient in place.

Other prior transfer devises have not been able to accomplish the transfer of patients in the smoothest pain-free manner possible. There have been conveyors introduced which may serve the purpose but would not be able to accommodate different-sized beds. These devises are set forth in U.S. Pat. Nos. 5,163,189; 4,776,047; 4,761,841; 3,769,642; 3,593,351; 3,413,663; 3,302,219; 2,733,452; 2,630,583; 2,536,707; 1,487,171; 1,263,611; 716,886; and 378,220. Likewise, US patents to DiMatteo and DiMatteo et al entails transferring a prone patient between a bed and another horizontal support by webs which move independently in a lateral direction; but, since the webs are in no way connected, the two support surfaces must be separated from each other during the transfer operation so that the movements of both webs do not interfere with each other. Therefore, the gap between both support surfaces would mean a lapse of support for the patient. In U.S. Pat. No. 4,747,170 to Knouse, a web attaches to the edge of the sheet on the patient's bed so that as the web is wound onto a roller it pulls the sheet, and thereby the patient, onto an adjacent support surface. But to do the vice-versa must be done from the other side of the bed which may not be accessible to the patient mover.

Carter, et al in U.S. Pat. No. 5,038,424, has improved on these other systems as described above by inventing a transfer system consisting of two support surfaces with the use of pliable webs, the opposite ends of which are wound about a pair of cylindrical rollers and driven by motors which are hydraulic. Another patent, U.S. Pat. No. 6,591,435 to Hodgetts is similar in the sense that it transports a patient from a bed to a stretcher or vice versa through the use of a bed sheet and a conveyor attached to the bed or the stretcher. A first end of the sheet is removably attached to the conveyor and a second end of the sheet is free. The sheet is adapted to be positioned onto the patient supporting member of the bed or stretcher. The conveyor includes a roller received by bearings. The roller can also include a telescopic arrangement so that its length can be adjusted.

Needless to say, all these contraptions cause discomfort and even pain to the patients being transferred and transported and would not work conveniently for patients in very serious condition. Movements incurred by transferring and transporting patients through such methods may even adversely affect their recovery.

Although this invention and its embodiments has as its primary purpose the convenient transfer of patients from one support surface to another with the minimum, if not zero, movement of the patient, there are secondary purposes which include the allowance of space and facilitation of air flow under a continuously-prone immobile patient to prevent bed sores; and, the convenient changing of bed sheets under an immobile patient which would ensure a hygienic environment for a critically-ill person forced to stay in hospital for a long period of time.

Those long-staying patients in medical facilities are often those who are critically ill, critically burned, comatose, or require surgical operations one after the other. Most often they are in a continual prone position subjecting them to the prevalence of pressure sores. Low air loss patient support structures or beds have been known in the medical field for the prevention and treatment of pressure sores. Support Systems International, Inc. has come up with exemplary low air loss beds relating to wound care management and prevention like their Flexicair and Restcue beds. Alternating pressure low air loss beds are also known; for example, U.S. Pat. No. 5,044,029 to Vrzalik which has air bags positioned alternatively in an inter-digital manner. For this purpose, this present invention would not need any other extra accessory. The planks can be lowered down and away or lowered to the sides and away from the patient's back in an alternating manner to facilitate air flow so that there would still be ample support under the patient whilst permitting air to circulate freely to the skin.

Again, for long-staying patients to which the slightest movement may cause excruciating pain, there is a need for a system to change bed linen with ease. Routine in hospital is to fold a linen lengthwise and position it along the length of the patient with the folded side pushed a little under the patient's back. Then the patient is turned a little in order to pull the other side of the sheet from underneath. This works only for patients that can be moved without entailing pain. However, this present invention includes 2 or 3-dimensional planks laid inter-digitally in 2 palettes to give a complete support surface to the patient but each plank, being separate from each other, can thus be fitted with a separate fitted sheet, also 2 or 3-dimensional. Therefore, they can be rotated periodically so that a clean side is always under the patient until such time that all two or three sides have been soiled and would necessitate its change Although this invention utilizes wooden or aluminum material or any other similar and suitable material to substitute, the planks can also be in the form of air bags which can be inflated or deflated alternatively to fit the purpose of the support surface. In this case, a pneumatic system needs to be introduced and changes made to the apparatus to accommodate such changes. The apparatus can also be changed from being manually operated to being powered, whether by electric, hydraulic, pneumatic, or whatever suitable energy.

This device to transfer and transport patients will be simple to operate and maintain and would not conflict with the other portions of the medical system; thus accomplishing the transfer and transport of patients from one location to another in a medical establishment in an efficient pain-free manner by a minimum of personnel.

SUMMARY OF THE INVENTION

This invention is an apparatus to transfer and transport patients consisting of two similar support surfaces for receiving and supporting a patient before transportation to another location for any purpose deemed necessary by medical staff. They may be maneuverable or set on the floor in a permanent manner depending on whether it is to transport a patient or not. Such systems should be accessible in radiology, burn units, testing units and other sections of the medical establishment for the easy, pain-free and convenient maneuvering of patients.

The support surfaces of these hospital beds would consist of two palettes each made of a series of rectangular 2-dimensional or triangular 3-dimensional planks inter-digitally positioned. Each palette can be moved interchangeably downwards to the sides, or straight down, and away from a patient's back. The two beds are placed beside each other's free side and when a palette of one bed is lowered down, the corresponding palette of the other where the patient is to be transferred is raised up to fill the void created by the lowering down of the previous palette. This is repeated until both palettes of one bed have taken the place of the palettes of the other bed thereby completing the new support surface where the patient lays. No movement is required from the patient nor any movement caused to the body. The maneuverable bed can then be moved away from the other to transport the patient to any location in the medical facility as desired.

In accordance with the embodiments of the system and as mentioned above, there are two similarly-designed support surfaces or hospital beds to support and receive a prone immobile patient for eventual transport to another section of a medical establishment and these two hospital beds are of 2 different kinds, one being stable and the other maneuverable for the transport of the patient. Both beds in this invention are operated manually but it is open to the possibility of changing the system from being manual to being pneumatic, hydraulic, electrical, or whatever with the addition of accessories like motors, gears, air and oil jacks, etc. The stable bed rests upon a strong structure made of any durable hard material. The head in each end of the bed has an arch under which are connecting sections running from one side of the structure to the other to make the structure more stable. The maneuverable bed likewise rests on an equally strong structure made of any durable hard material just like the stable bed but the base of the maneuverable bed has wheels attached to the base structure to enable the transport and transfer of patients to another location in the medical establishment.

An aspect of this invention is that each of the 2 beds which compose this system has 2 palettes each composed of 2-dimensional rectangular or 3-dimensional triangular planks placed in an inter-digital manner (i.e. there is equal space between each plank). At the sides of the bed heads are holes to which each opposite ends of one palette are attached. Corresponding holes also hold firmly in place the other palette. There are holes in both stable and maneuverable beds to which are positioned locking pins which have been set on corresponding holes in each opposite side to serve as locking mechanisms and to keep the palettes in place.

Embodiments of this invention include the fact that the two palettes in the stable bed are similar to the palettes of the maneuverable bed. One is composed of an axle rod which holds it in place to the base of the bed and on each end of the axle rod are two grooves wherein one is bored beside the handle end of the axle rod and one at the other end. To ensure the permanent stable position of the axle rod to the base structure of the bed there are 2 curved pins in place inside the grooves. The Axle rod is firmly set into the grooves. This one palette has approximately seven strong rods each having one end attached to the axle rod attached to the bed structure base while the other end is free to enable the sliding in of a plank. On each rod end are 3 holes angled equally (120 degrees) to each other to which a metal ball bearing assembly positioned on the hole of a plank is set to ensure the stable positioning of the plank on the rod and to prevent unwanted movements. The handle end is attached to the axle rod for easy and convenient manual rotating work. At the end of this handle is a hole to which a locking pin is positioned. Likewise, there is a plastic covering at the end of the handle similar to the plastic cover at the ends of motorcycle handle bars. This has no purpose other than for comfort and beauty.

In accordance with this embodiment, the locking pin is to contribute to the stabilization of the palette when positioned. It is a metal on the handle which is slid into a hole making one locking mechanism set which then goes into another hole in the base structure thereby locking the whole palette securely onto the structure base.

The other palette is composed of an axle rod which holds it in place to the base of the bed. On each end of the axle rod are two grooves wherein one is positioned beside the handle end and the other at the other end. To ensure the permanent stable position of the axle rod to the base structure of the bed, there are 2 curved pins in place inside the grooves. The axle rod is firmly set into the grooves. This palette has approximately six rods each having one end attached to the axle rod attached to the bed structure base while the other end is free to enable the sliding in of a plank. On each rod end are 3 holes angled equally (120 degrees) to each other to which a metal ball bearing assembly positioned on the hole of a plank is set to ensure the stable positioning of the plank on the rod and to prevent unwanted movements. On each rod of this particular palette, which is one of the two, what is different from the other is that at the end side attached to the axle rod, there is a curvature which is an essential part of the design to ensure that this particular palette does not touch against the other palette. The handle end of the rod is attached to the axle rod for easy and convenient manual rotating work. At the end of this handle is a hole to which a locking pin is positioned. Likewise, there is a plastic covering at the end of the handle similar to the plastic cover at the ends of motorcycle handle bars. This has no purpose other than for comfort and beauty. The locking pin is to contribute to the stabilization of the palette when positioned. It is a metal on the handle which is slid into a hole making one locking mechanism set which then goes into another hole in the base structure thereby locking the whole palette securely onto the structure base.

The planks which have been mentioned can either be rectangular 2-dimensional planks or triangular 3-dimensional planks which when placed in an inter-digital manner in a series become 1 palette. Each plank, this composite unit of the two palettes as mentioned has a center which goes through the whole length of the plank and would be useful in enabling the plank to rotate. The planks are each slid into a corresponding rod as mentioned above which has been attached permanently to the side of the bed structure. Each plank can be made of any solid durable material, whether wood, aluminum or any other suitable material, and each has a hole which is the rotating center and through which the planks are put together to make one palette. To ensure that each plank does not move loosely or shake or cause the turning of the palette thereby leading to the off balance of the patient, a ball bearing assembly has been put in place wherein a round metal ball is attached to a spring and both are positioned inside a hole which is again positioned over another hole in the plank. A groove is made on the hole to keep a curved metal firmly in place. Another groove keeps the metal ball in place. A hole at the end of each rod mentioned above is for the purpose of putting the metal ball bearing assembly in place. Also, this mechanism will enable the palette to stay firm when in one position and not to move unnecessarily.

Another aspect of the planks is that each has a soft permanent cover, preferably made of foam but may be made of any other suitable soft sponge-like material, which goes around each plank and also around the plank is a removable changeable bed sheet to keep clean the permanent cover. Through the rotation of each plank this sheet is likewise rotated thus ensuring that a clean side is always under the patient's back. If the plank is 2-dimensional there would be 2 sheet changes and if 3-dimensional there would be 3 sheet changes after which each fitted sheet is slid out and a clean one put in place. All the planks would be similar in all the four palettes of the two beds.

Another aspect of the invention is that although it is mentioned that the planks are made of strong, hard and durable material, an alternative would be that instead of using planks as the composite units of the palettes, plastic sacs can be used which can then be filled with air like a balloon to be pressurized as desired. Pressure can be regulated as desired and this mechanism would not only be useful for the prevention of bed sores in a patient but would also serve the same purpose as claimed above to transfer and transport patients.

It must be reiterated that the system as described is manual. However, the device can easily be altered in such a way that it can be operated electrically, hydraulically, pneumatically, and etc.

To transfer and transport a patient, the maneuverable bed is positioned beside the stable bed where the patient lies then the palettes of the maneuverable bed are turned 90 degrees downwards to the side of the bed after which one palette of the stable bed is cranked 90 degrees downwards thereby creating spaces to which the planks of one palette of the maneuverable bed can fill. The maneuverable bed is then slid into the stable bed and a palette raised 90 degrees upwards to fill up the empty spaces. Next, a palette of the stable bed is cranked downwards then the other palette of the maneuverable bed raised to fill the empty spaces. The patient is now completely transferred onto the maneuverable bed, ready to be transported. Finally, the maneuverable bed is separated from the stable bed.

Still another aspect of the invention is a further beneficial use in that each plank as mentioned above can be separately fitted with separate linen. This gives convenience when changing bed linen without the necessity of lifting the patient or moving the patient even slightly. Palettes can be interchangeably lowered downwards or to the sides away from the patient's back and have their fitted sheets changed. The planks can be rotated periodically to ensure that a clean side is always under the patient.

It is of further benefit that this invention makes it possible to accommodate the free passage of air flow under the patient's back to prevent the development of bed sores in continuously-prone and critically-ill patients. The palettes can be interchangeably lowered downwards or to the sides away from the patient's back in timed intervals to ensure that the patient's back is uniformly opened to the free flow of air. This is also very important for critically-burned patients.

BRIEF DESCRIPTION OF THE DRAWINGS

To completely appreciate this invention and its uses thereof, figures are presented which in brief are.

DETAILED DESCRIPTION OF THE EMBODIMENTS

Type A

With the Type A beds, the position change of the planks in both the stationary and maneuverable beds is made possible by the manual method. However, it should be noted that movement of the rod can likewise be facilitated by electronic and mechanical control with the use of accessories such as motors and gear boxes. This system has been designed to move the planks in rods in an upwards and downwards motion.

Figure 1:
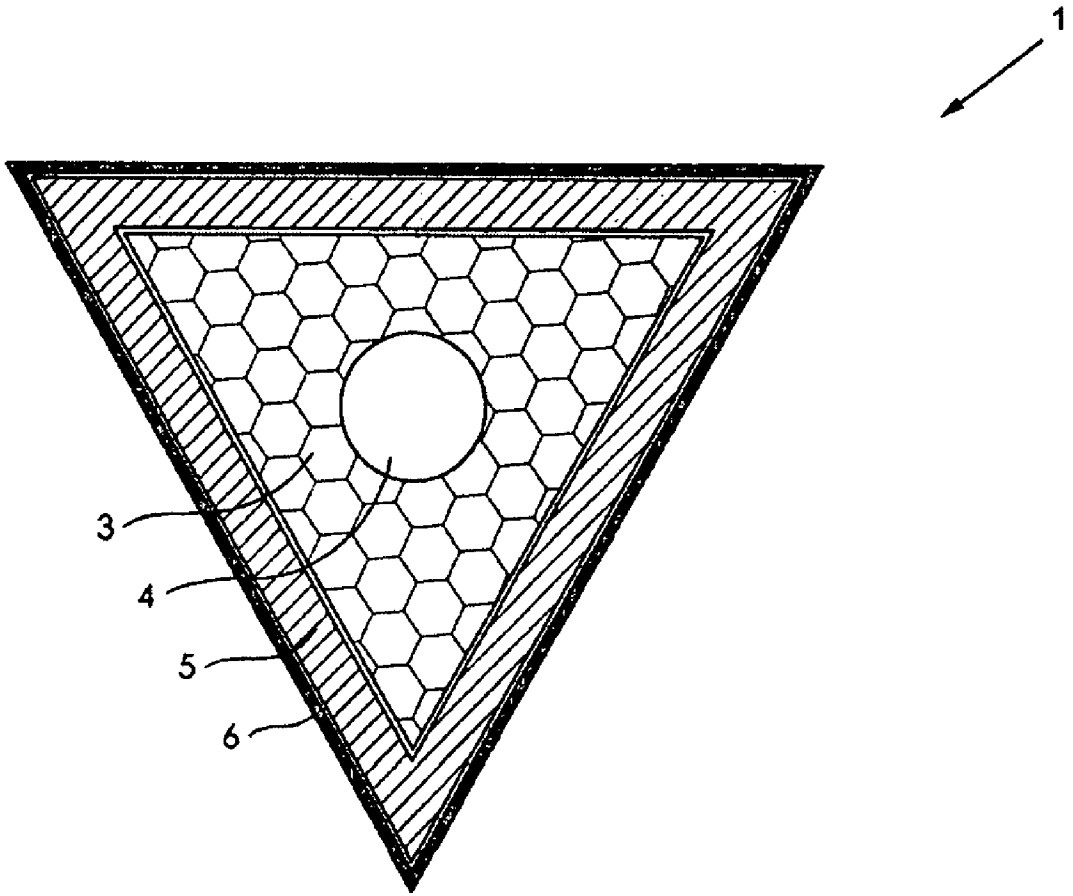
FIG. 1. Cross-section of wedge-shaped planks (1) with interior view
Figures 2, 3:
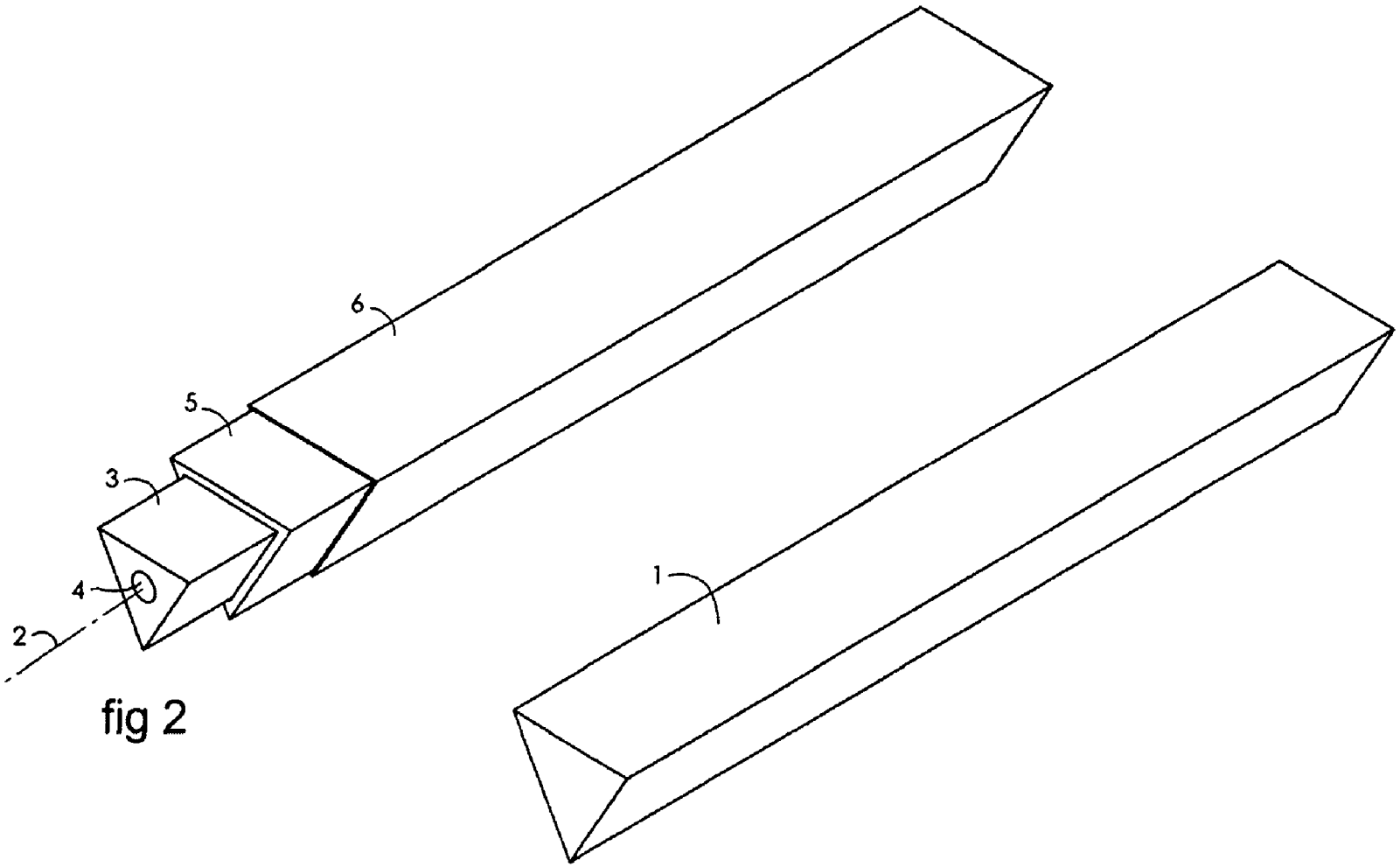
FIG. 2. Front perspective of wedge-shaped planks (1) with interior view
FIG. 3. Front perspective of wedge-shaped planks (1)

A detailed description of the embodiments herein commences with reference to Figures (FIGS. 1, 2 & 3). There is shown 1 which is a triangular 3-dimensional plank which when placed in an inter-digital position in a series becomes 1 palette. It must be mentioned here that this plank, this composite unit of the palette, do not have to be only 3-dimensional. It can also be a 2-dimensional rectangle. Each plank has a center 2 which goes through the whole length of the plank and would be useful in enabling the plank to rotate. The planks are each slid into a corresponding rod 7 and each of these rods has been attached permanently to the side of the bed 23.

Figure 7:
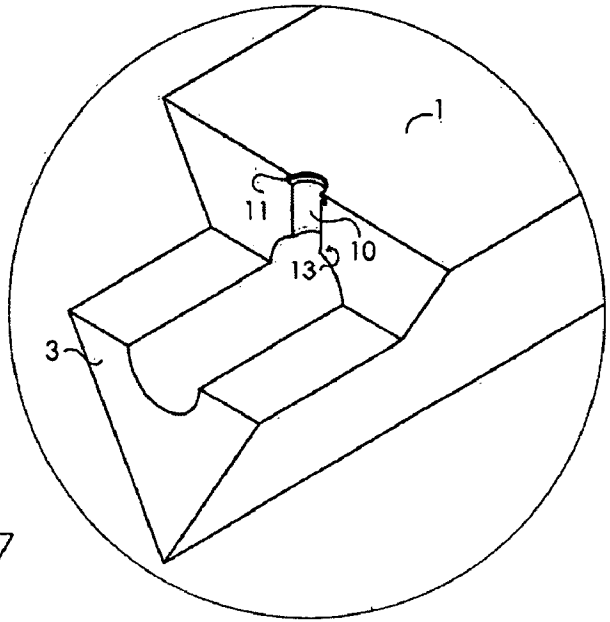
FIG. 7. Front perspective of plank center base (3) showing location of hole number 10 and groove number 11 relative to hole number 4.
Figure 8:
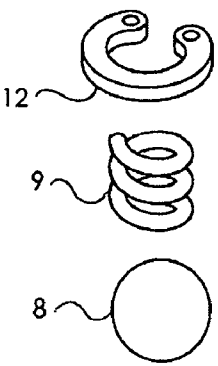
FIG. 8. Front view of curved metal spring (12), spring number 9 and metal ball (8)
Figure 6:
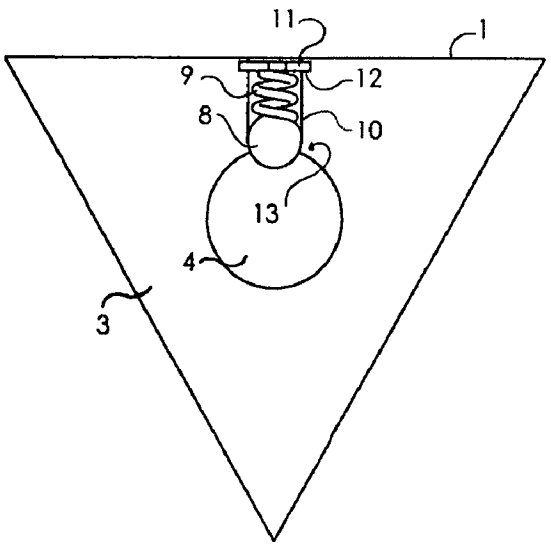

Each plank can be made of any solid durable material, whether wood, aluminum or any other suitable material, and each has a hole 4 which is the rotating center and through which the planks are put together to make one palette. To ensure that each plank does not move loosely or shake or cause the turning of the palette thereby leading to the off balance of the patient, a ball bearing assembly has been put in place wherein a round metal ball 8 is attached to a spring 9 and both are positioned inside a hole 10 which is again positioned over hole 4 in the plank (FIGS. 6, 7 & 8). A groove is made on hole 10 to keep a curved metal 12 in place firmly. Another groove 13 keeps the metal ball in place.

Figure 5:
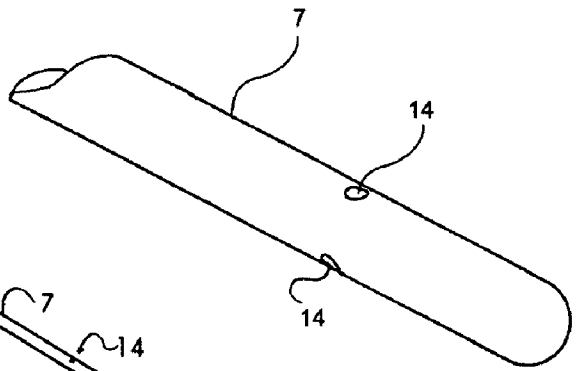
Figure 4:
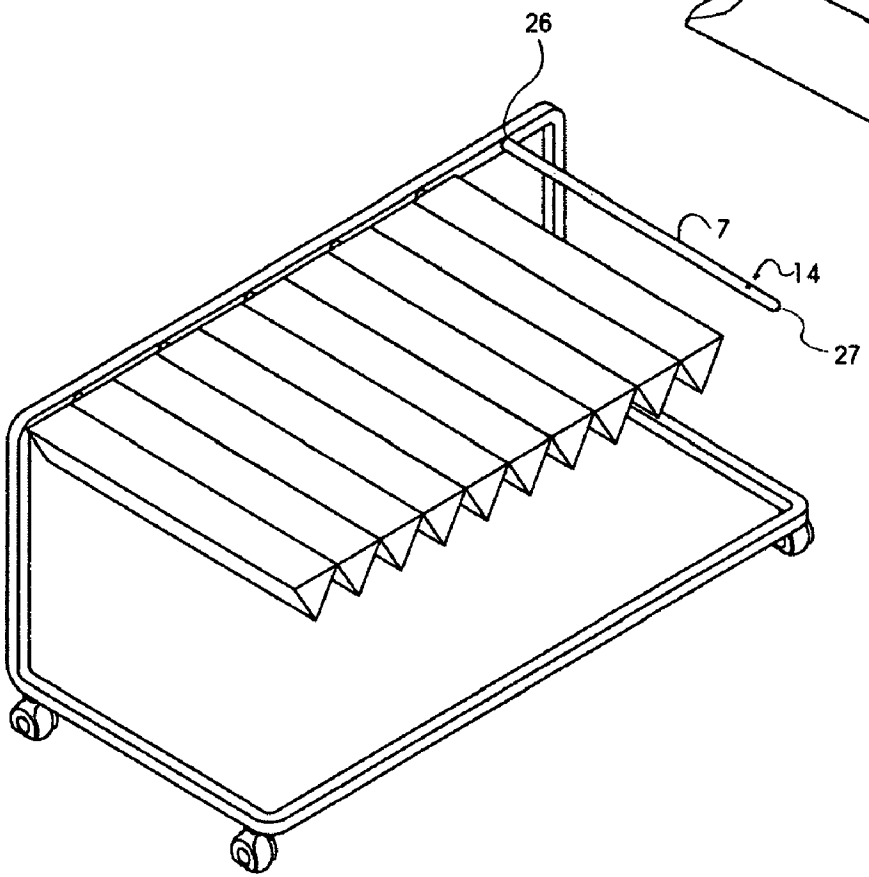
FIG. 4. Front perspective of one maneuverable bed showing position of palette axle rod FIG. 5. Enlarged front view of palette axle rod showing position of hole number 14 on its end FIG. 6. Front cross-section of center base (3) of planks showing location of metal ball bearing assembly (the latter consisting of ball (8), spring (9) and hole number 4).

Hole 14 at the end of each rod 7 is for the purpose of putting the metal ball bearing assembly in place (FIGS. 4 & 5). Also, this mechanism will enable the palette to stay firm when in one position and not to move unnecessarily.

Each plank has a soft permanent cover 5, preferably made of foam but may be made of any other suitable soft sponge-like material, which goes around each plank. (An alternative is given as part of this invention. The Type C beds, details of which will be given below, would be using plastic sacs instead of planks as the composite units of the palettes. These sacs can then be filled with air like a balloon to be pressurized or depressurized as desired to alter their volume; and thus, their size. [FIGS. 51-58])

Also around the plank is a removable changeable bed sheet 6 to keep clean permanent cover 5 and through the rotation of each plank this sheet 6 is likewise rotated thus ensuring that a clean side is always under the patient's back. If the plank is 2-dimensional there would be 2 sheet changes and if 3-dimensional there would be 3 sheet changes after which each fitted sheet is slid out and a clean one put in place.

All the planks would be similar in all the four palettes of the two beds making up the Type A system.

These two hospital beds are of 2 kinds: one stable and the other maneuverable for the transport of the patient. Both beds in this invention are operated manually but it should be noted that accessories like motors, gears, air and oil jacks, etc., can be added to change the system from being manual to being pneumatic, hydraulic, electrical, or whatever.

Figures 9, 10, 11:
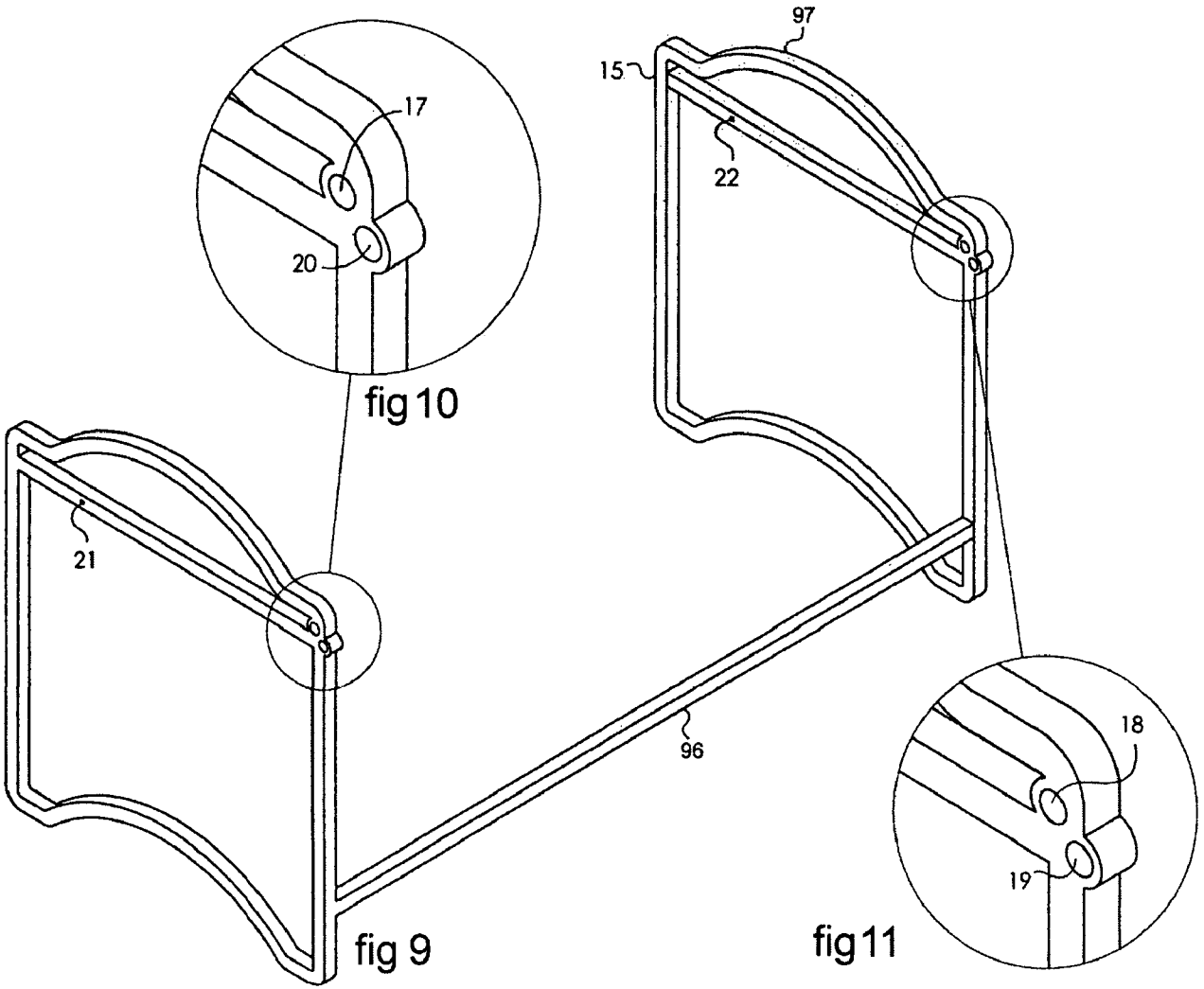
FIG. 9. Front perspective of the stationary bed structure (15), rod rotational movement system FIG. 10. Enlarged detailed front view of the position of holes (17 and 20) on the structure (15) of the stationary bed, rod rotational movement system FIG. 11. Enlarged detailed front view of the position of holes (18 and 19) on the structure (15) of the stationary bed, rod rotational movement system FIG. 12. Front perspective of palette number 16

(1) The Stable Bed (FIG. 9)

Upon the base of the bed rests a strong structure 15 which is made of any durable hard material. The head in each end of the bed has an arch 97 under which are connecting sections 96 running from one side of the structure to the other to make the structure more stable. They have holes 21 and 22 to which is positioned locking pin 31 which has been set on holes 30 and 42 in each opposite side. Each bed has 2 palette 16 (FIG. 12) and 29 (FIG. 17), each composed of 2-dimensional rectangular or 3-dimensional triangular planks placed in an interdigital manner (i.e. there is equal space between each plank). At the sides of the bed heads are holes 17 to which one end of palette 16 is attached and 18 to which the other end is attached. Holes 19 and 20 hold each end of palette 29. (FIGS. 10 & 11)

Figures 12, 13, 14, 15, 16:
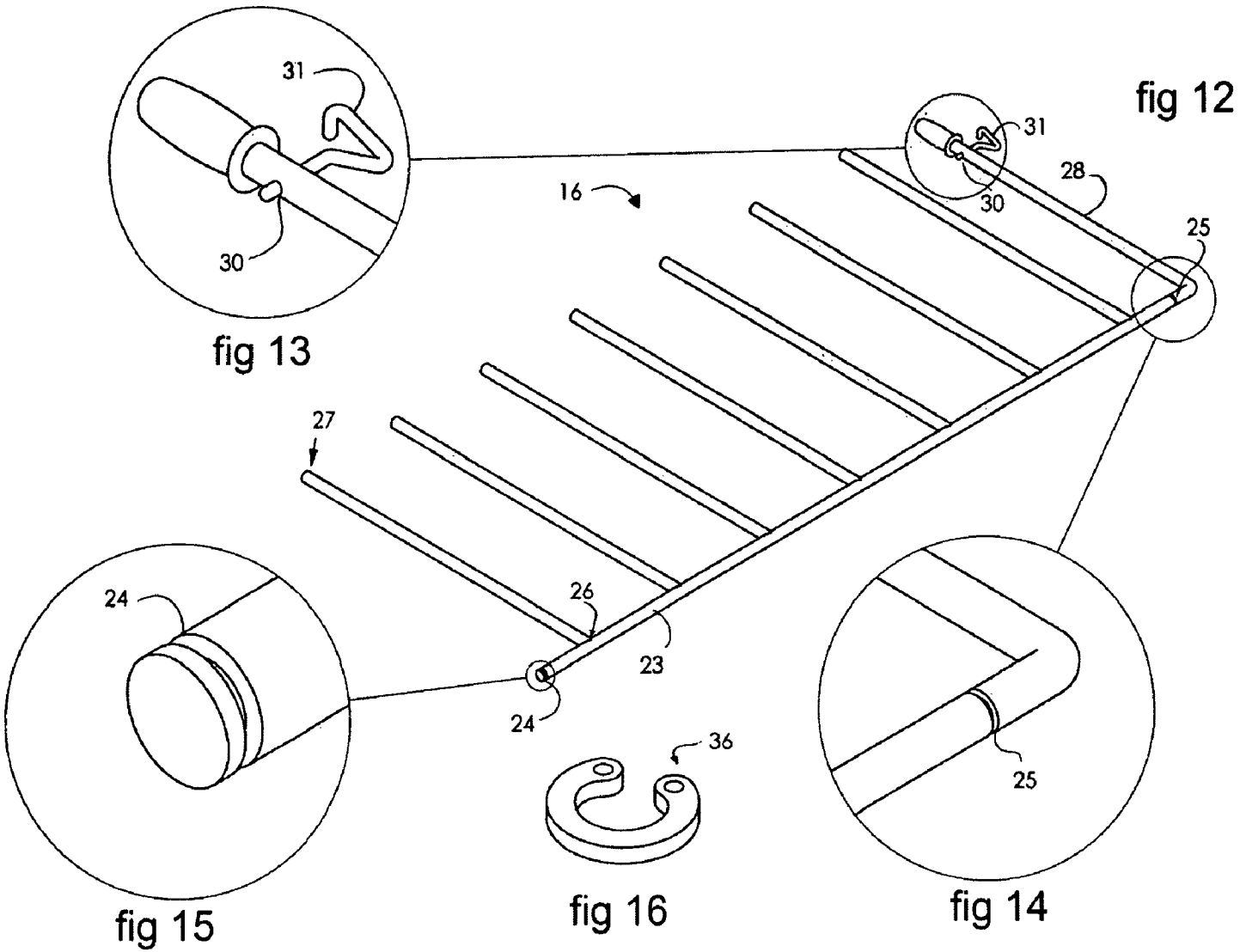
FIG. 13. Enlarged front view of lever handle end (28) and pin (31)
FIG. 14. Enlarged front view of groove (25) to which is positioned the curved pin (36)
FIG. 15. Enlarged front view of groove (24) to which is positioned the curved pin (36)
FIG. 16. Front view of curved pin (36)

Palette 16 is composed of: an axle rod 23 which holds palette 16 in place to the base of the bed. On each end of the axle rod are two grooves 24 and 25 wherein groove 25 is positioned beside the handle end and groove 24 at the other end (FIG. 14 & 15). To ensure the permanent stable position of axle rod 23 in the base structure of the bed 15, there are 2 curved pins 36 (FIG. 16) in place inside grooves 24 and 25. Axle rod 23 is firmly set into grooves 24 and 25.

In palette 16 are approximately seven rods 7. Each rod 7 for each plank is a strong rod in which one end 26 is attached to axle rod 23 while the other end 27 is free to enable the sliding in of the plank. On each rod end 27, there are 3 holes angled equally (120 degrees) to each other to which the metal ball 8 bearing assembly on the hole of each plank is set to ensure the stable positioning of the plank on the rod and to prevent unwanted movements.

Handle end 28 is a rod attached to axle rod 23 for easy and convenient manual rotating work. At the end of this handle is hole 30 to which pin 31 is positioned inside (FIG. 13). Likewise, there is a plastic covering 32 at the end of the handle similar to the plastic cover at the ends of motorcycle handle bars. This has no purpose other than for comfort and beauty.

With regards to pin 31, its purpose is to contribute to the stabilization of the palette when positioned. It is a metal on the handle which is slid into a hole 30 making one locking mechanism set which then goes into a hole 21 in the base structure thereby locking the whole palette onto the structure base 15.

Figures 17, 18, 19:
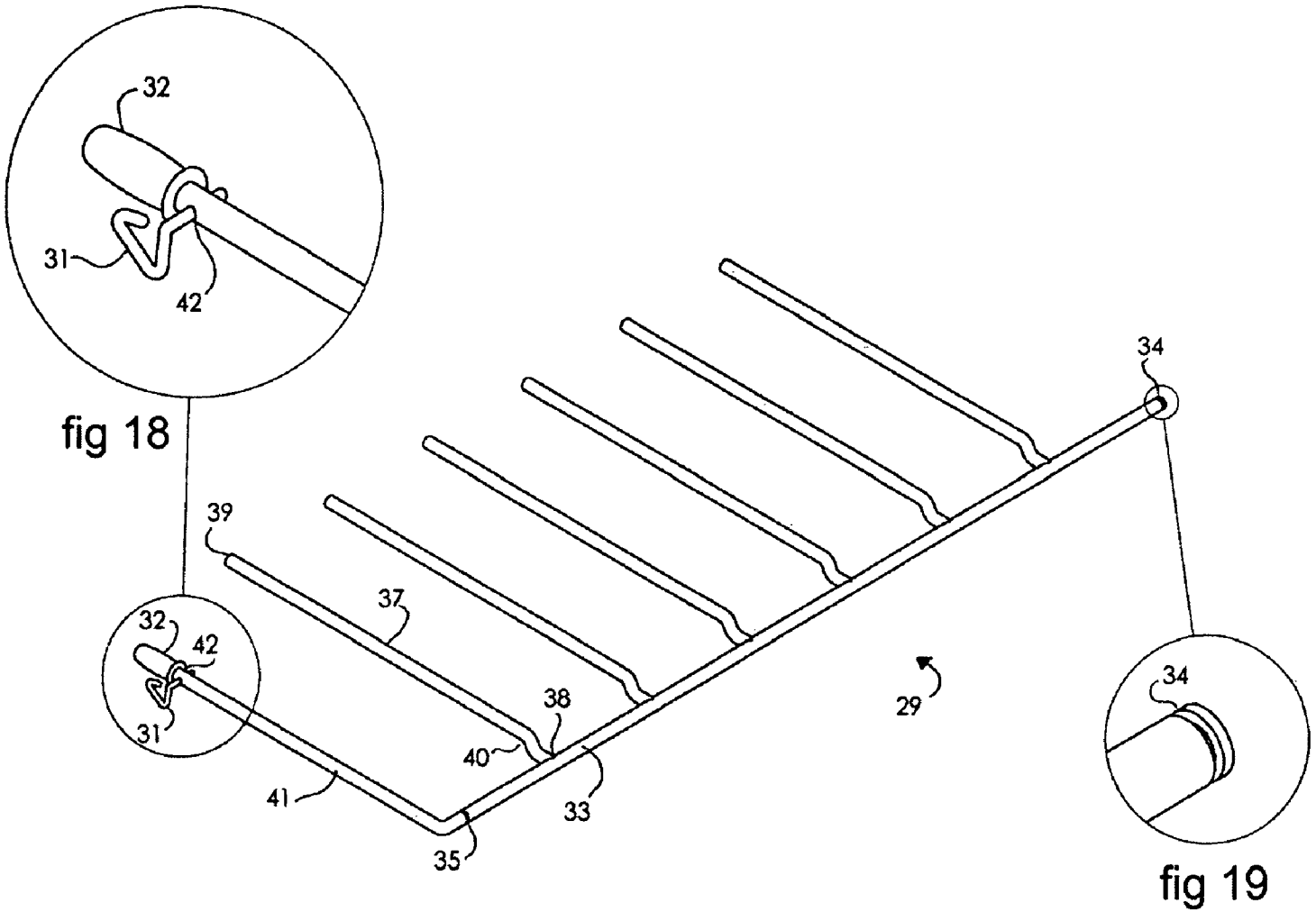
FIG. 17. Front perspective of palette number 29
FIG. 18. Enlarged front view of lever handle end (32) and pin (31)
FIG. 19. Enlarged front view of groove (34) to which is positioned the curved pin (36)

Palette 29 is composed of: an axle rod 33 which holds palette 16 in place to the base of the bed. On each end of the axle rod are two grooves 34 and 35 wherein groove 35 is positioned beside the handle end and groove 34 at the other end (FIG. 19). To ensure the permanent stable position of axle rod 33 in the base structure of the bed 15, there are 2 curved pins 36 in place inside grooves 34 and 35. Axle rod 33 is firmly set into grooves 34 and 35.

In palette 29 are approximately six rods 37. Each rod 37 for each plank is a strong rod in which one end 38 is attached to axle rod 33 while the other end 39 is free to enable the sliding in of the plank. On each rod end 39, there are 3 holes angled equally (120 degrees) to each other to which the metal ball 8 bearing assembly on the hole of each plank is set to ensure the stable positioning of the plank on the rod and to prevent unwanted movements.

On rod 37, at the end side attached to axle rod 33, there is a curvature 40 which is an essential part of the design to ensure that palette 16 does not touch against palette 29.

Handle end 41 is a rod attached to axle rod 33 for easy and convenient manual rotating work. At the end of this handle is hole 42 to which pin 31 is positioned inside (FIG. 18). Likewise, there is a plastic covering 32 at the end of the handle similar to the plastic cover at the ends of motorcycle handle bars. This has no purpose other than for comfort and beauty.

With regards to pin 31, its purpose is to contribute to the stabilization of the palette when positioned. It is a metal on the handle which is slid into a hole 42 making one locking mechanism set which then goes into a hole 22 in the base structure thereby locking the whole palette onto the structure base 15.

(2) The Maneuverable Bed

Figures 20, 21, 22:
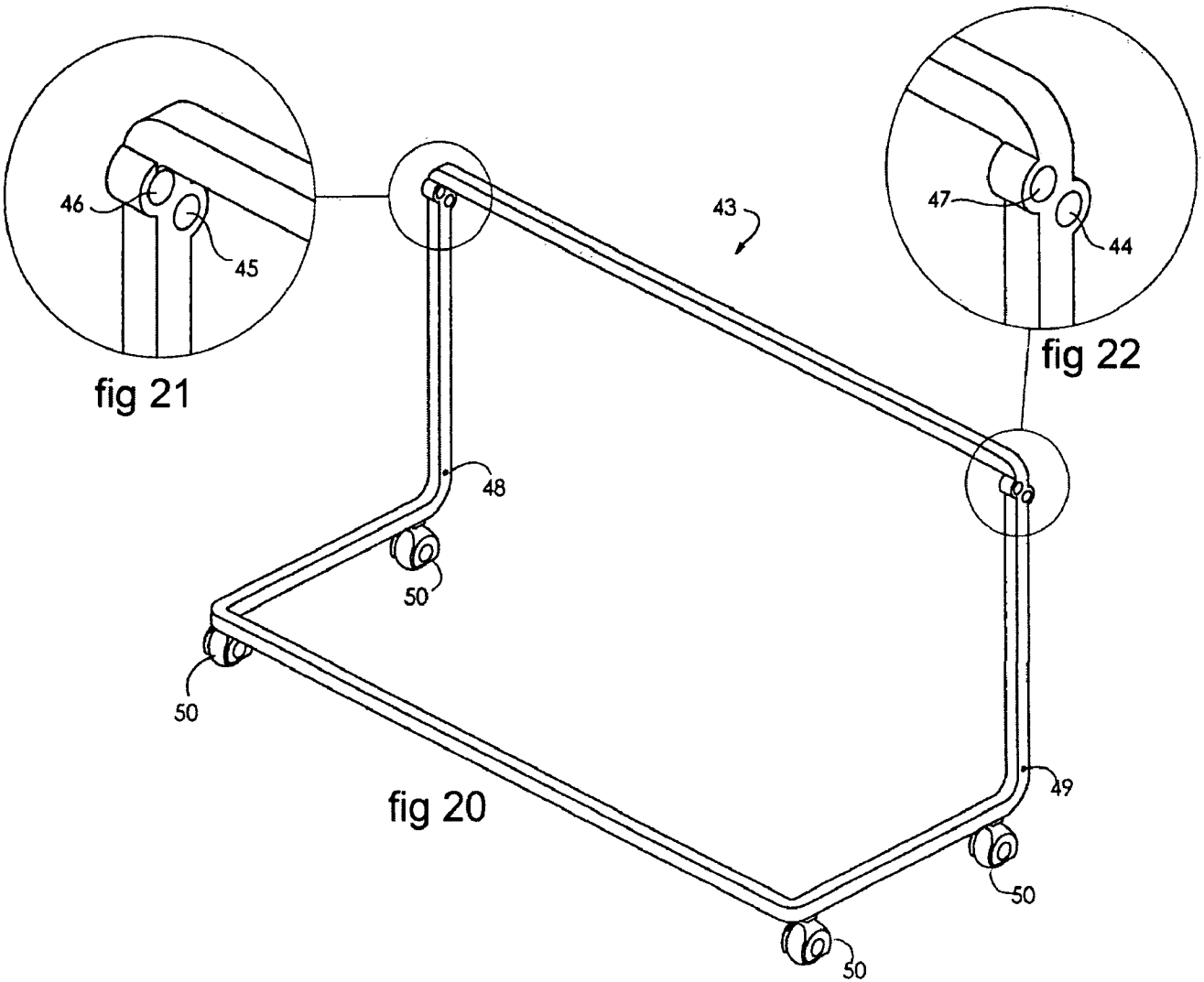
FIG. 20. Front perspective of maneuverable bed structure (43), rod rotational movement system FIG. 21. Enlarged detailed front view of the position of holes (45 and 46) on structure number 15 of the maneuverable bed, rod rotational movement system FIG. 22. Enlarged detailed front view of the position of holes (44 and 47) on structure number 15 of the maneuverable bed, rod rotational movement system FIG. 23. In this front view can be seen the stationary and maneuverable beds of the rod rotational movement system with a dummy lying on the stationary bed to be transferred onto the maneuverable bed FIG. 24. The first and second palettes of the maneuverable bed, rod rotational movement system, being lowered FIG. 25. The first palette of the stationary bed, rod rotational movement system, being lowered thus providing space for the planks of the second palette of the maneuverable bed i.e. there would be empty spaces between the planks of the second palette of the stationary bed FIG. 26. The maneuverable bed moves towards the stationary bed FIG. 27. The second palette of the maneuverable bed is raised thereby filling the empty spaces between the planks of the second palette of the stationary bed FIG. 28. The second palette of the stationary bed is lowered and the dummy patient is now lying on the first palette of the maneuverable bed FIG. 29. The place of the first palette of the maneuverable bed is now filled; therefore, the dummy patient is now completely lying on the maneuverable bed FIG. 30. The maneuverable bed is now taken away from the stationary bed FIG. 31. Front perspective of the structure of the pneumatic stationary bed (51)
Figure 23:
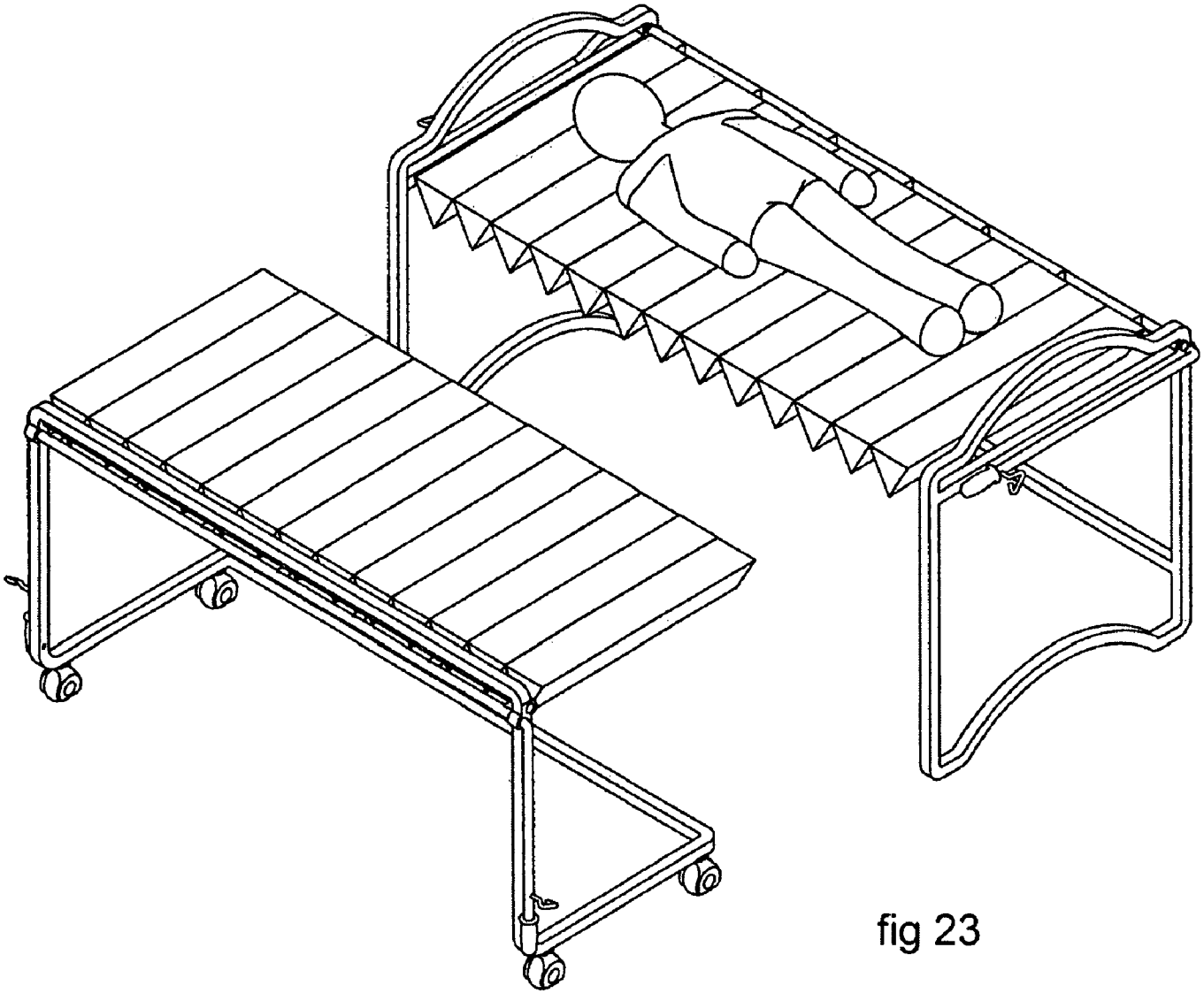
Figure 24:
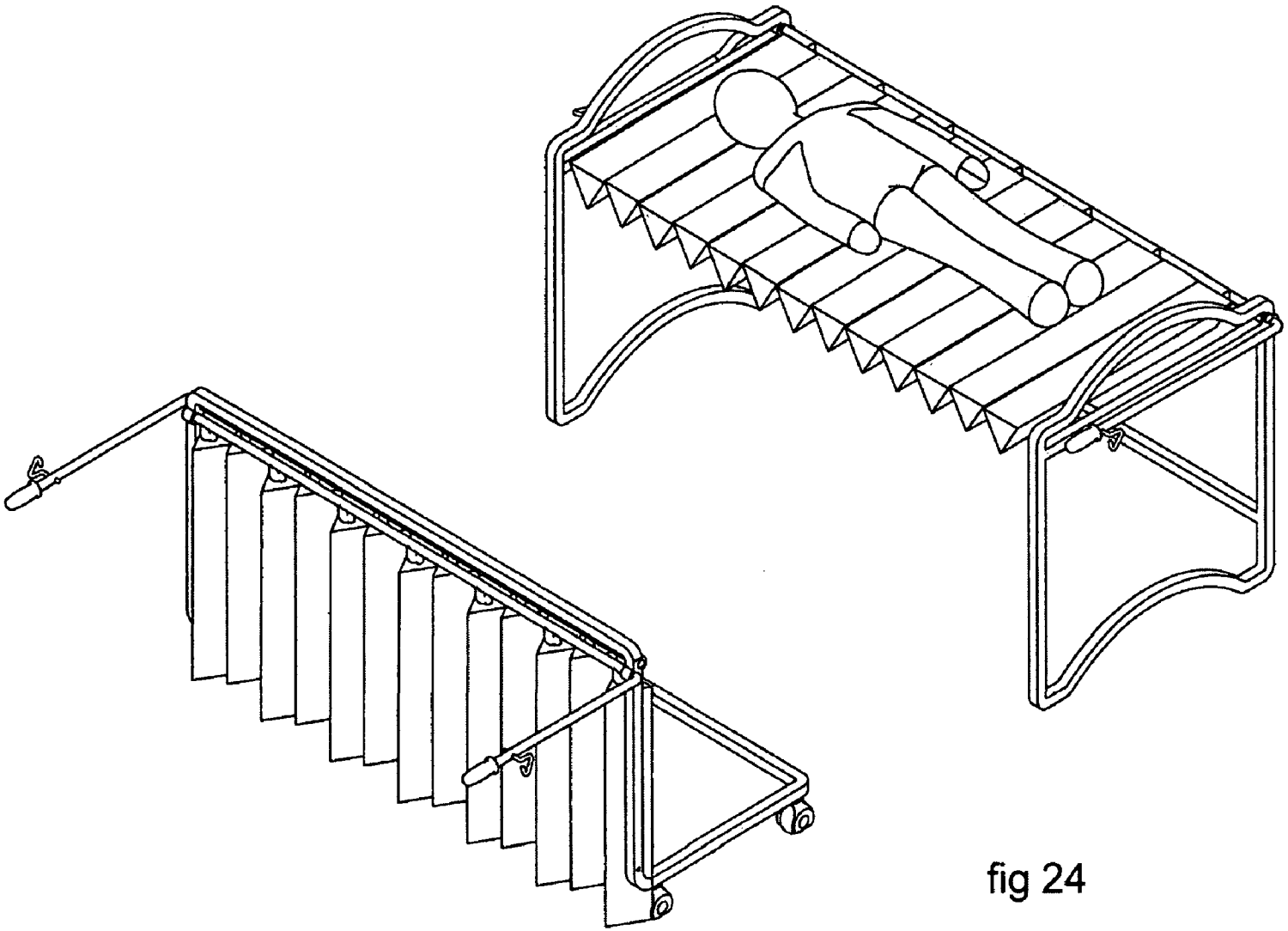
Figure 25:
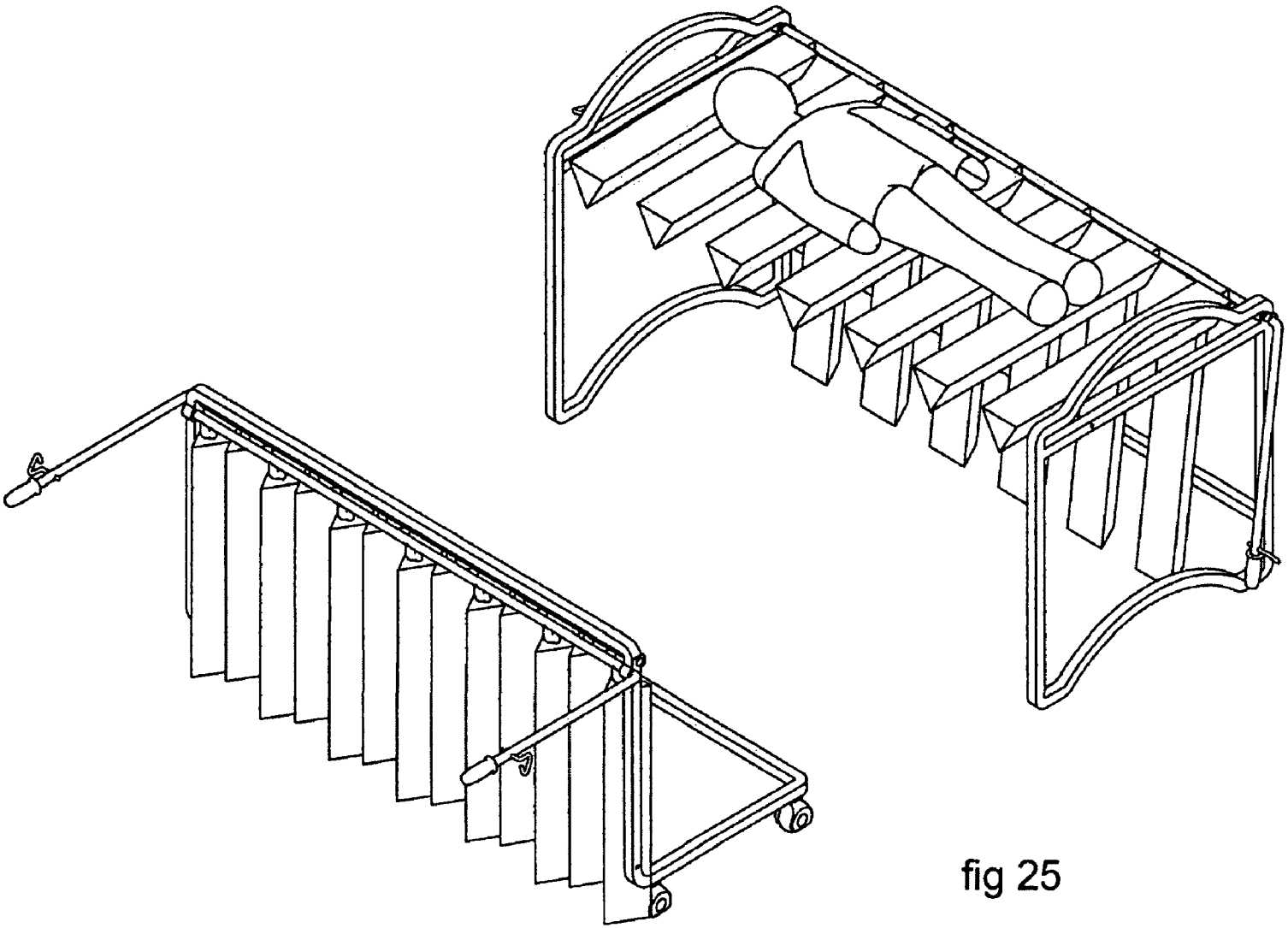
Figure 26:
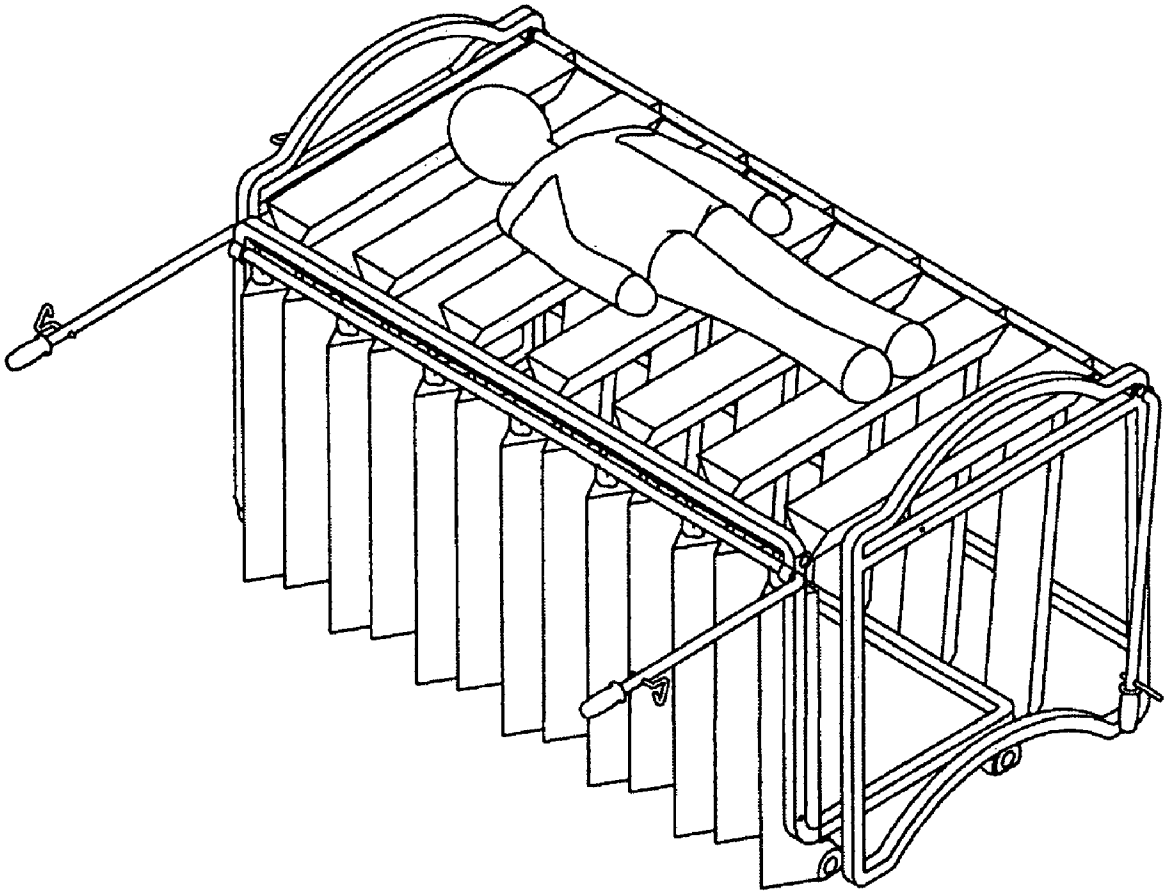
Figure 27:
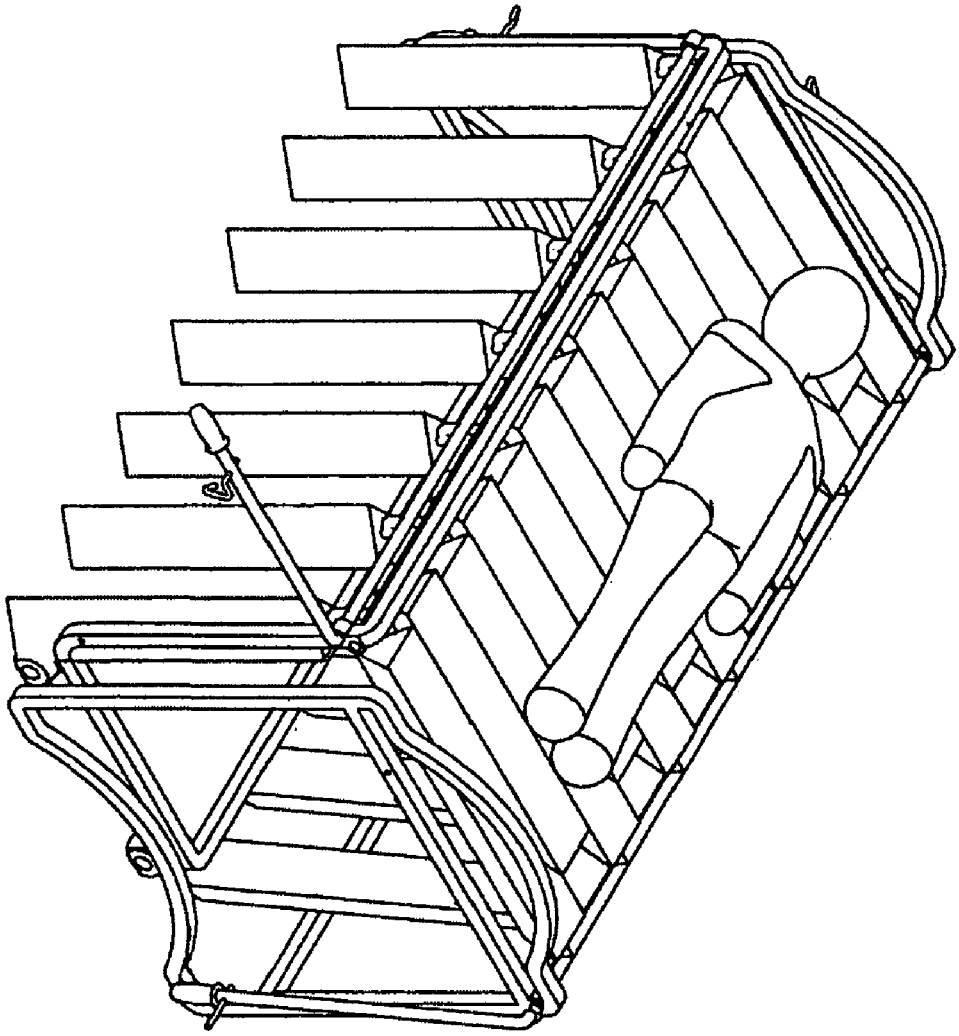
Figure 28:
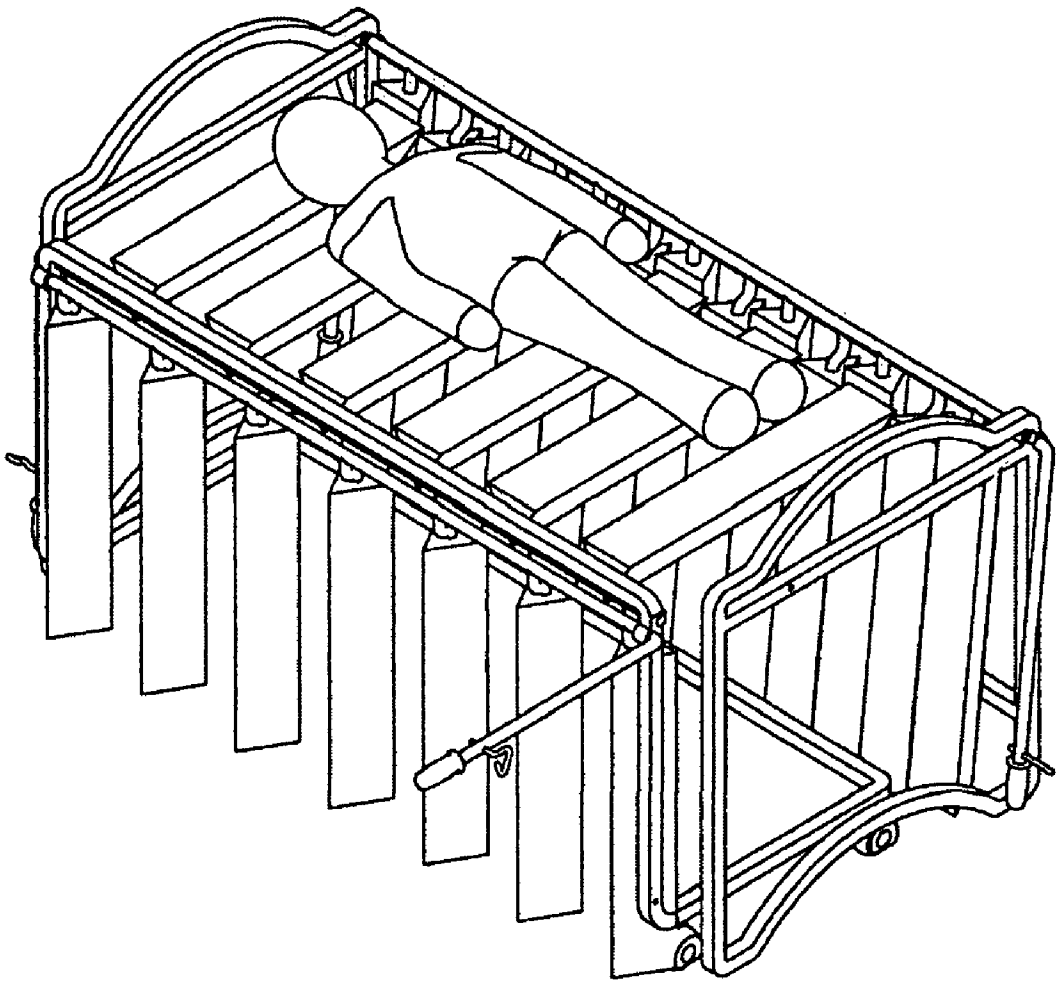
Figure 29:
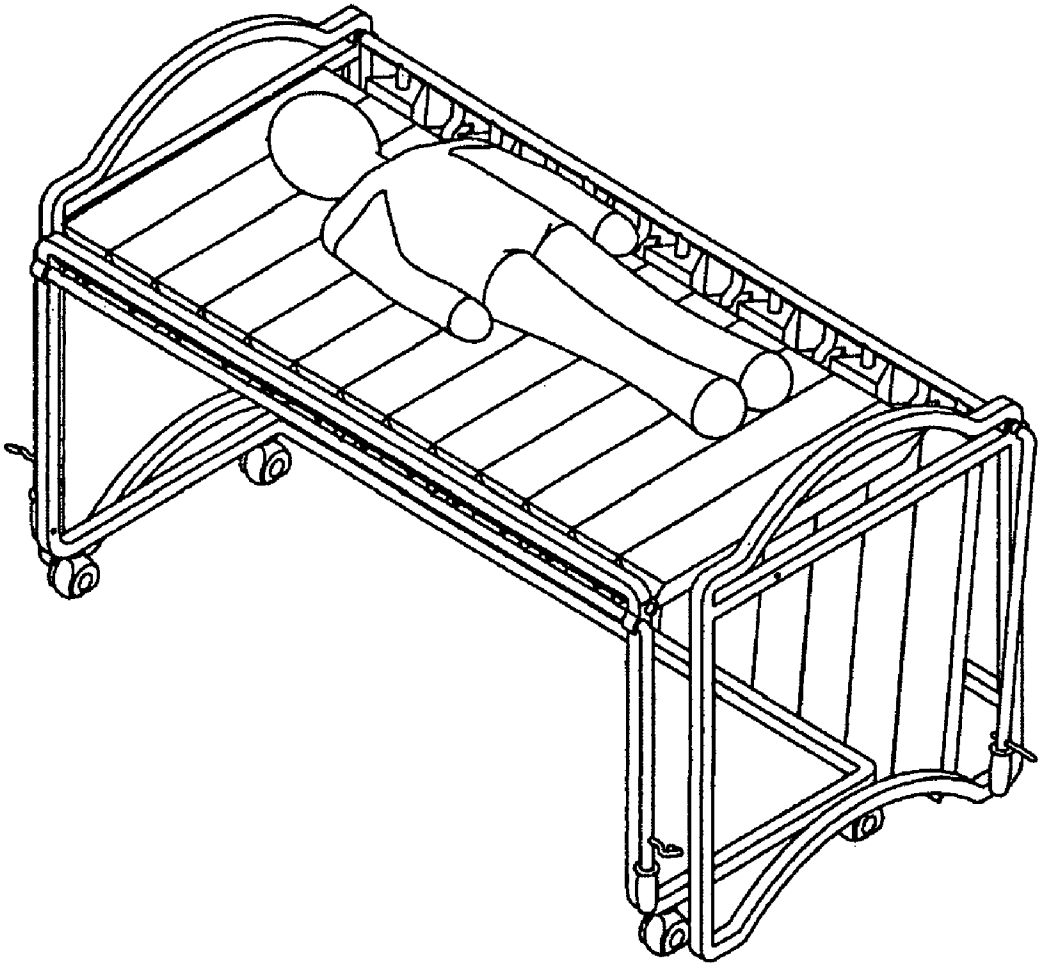
Figure 30:
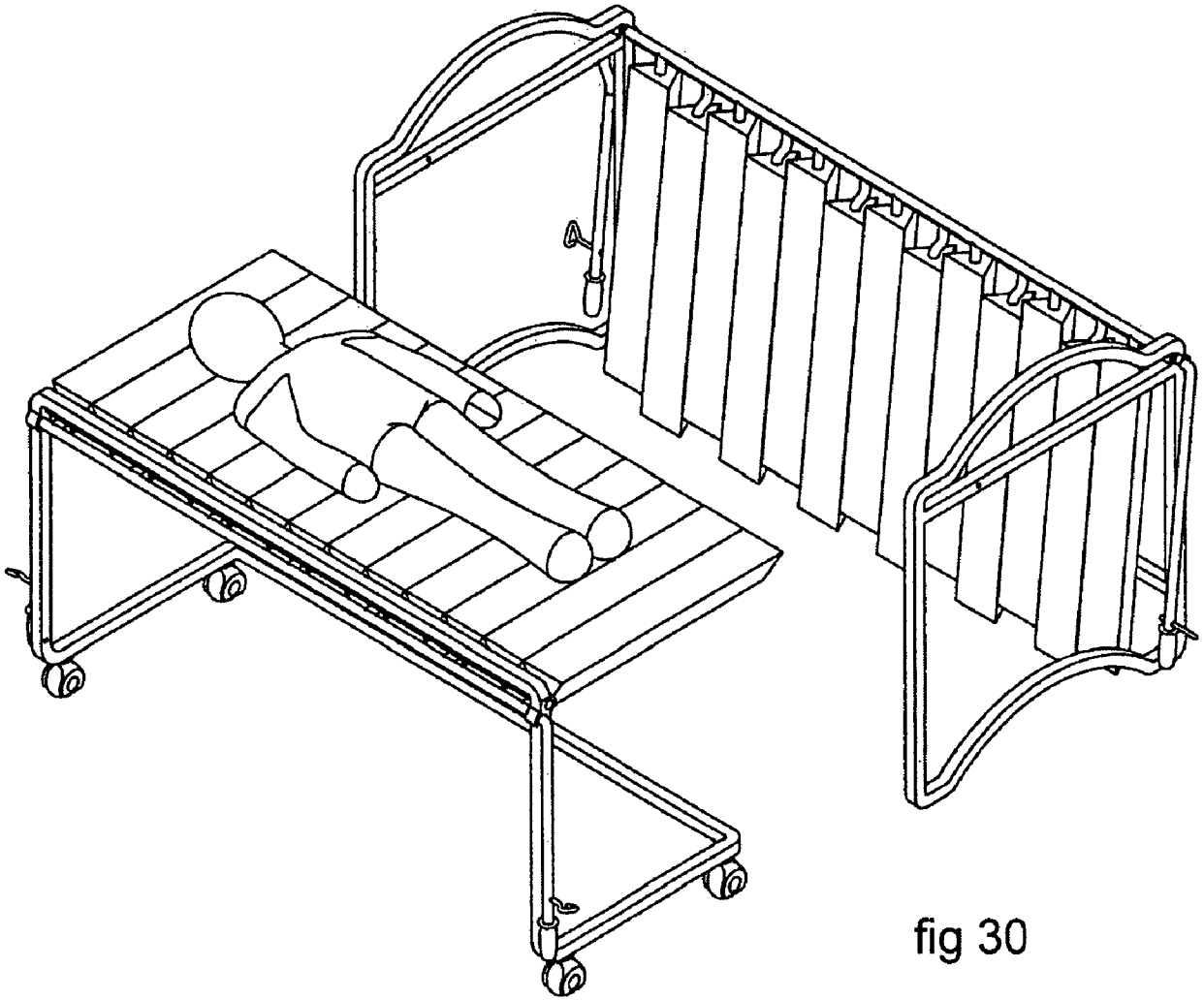

Upon the base of the bed rests a strong structure 43 (FIG. 20) which is made of any durable hard material and has holes to keep the palettes in place: Hole 44 to position axle rod 23 in place and hole 45 to hold one end of palette 16; hole 46 keeps in place the head section of palette 29 and hole 47 is for its side handle; hole 48 facilitates the entry of pin 33 which is in the handle of palette 16 and hole 49 for pin 31 in the handle of palette 29. (FIGS. 21 & 22)

This base has 4 wheels 50 attached to the base structure 43 to enable the transport and transfer of patients to another location in the medical establishment.

The palettes 16 and 29 of both stationary and maneuverable beds are similar.

Type B

Figure 39:
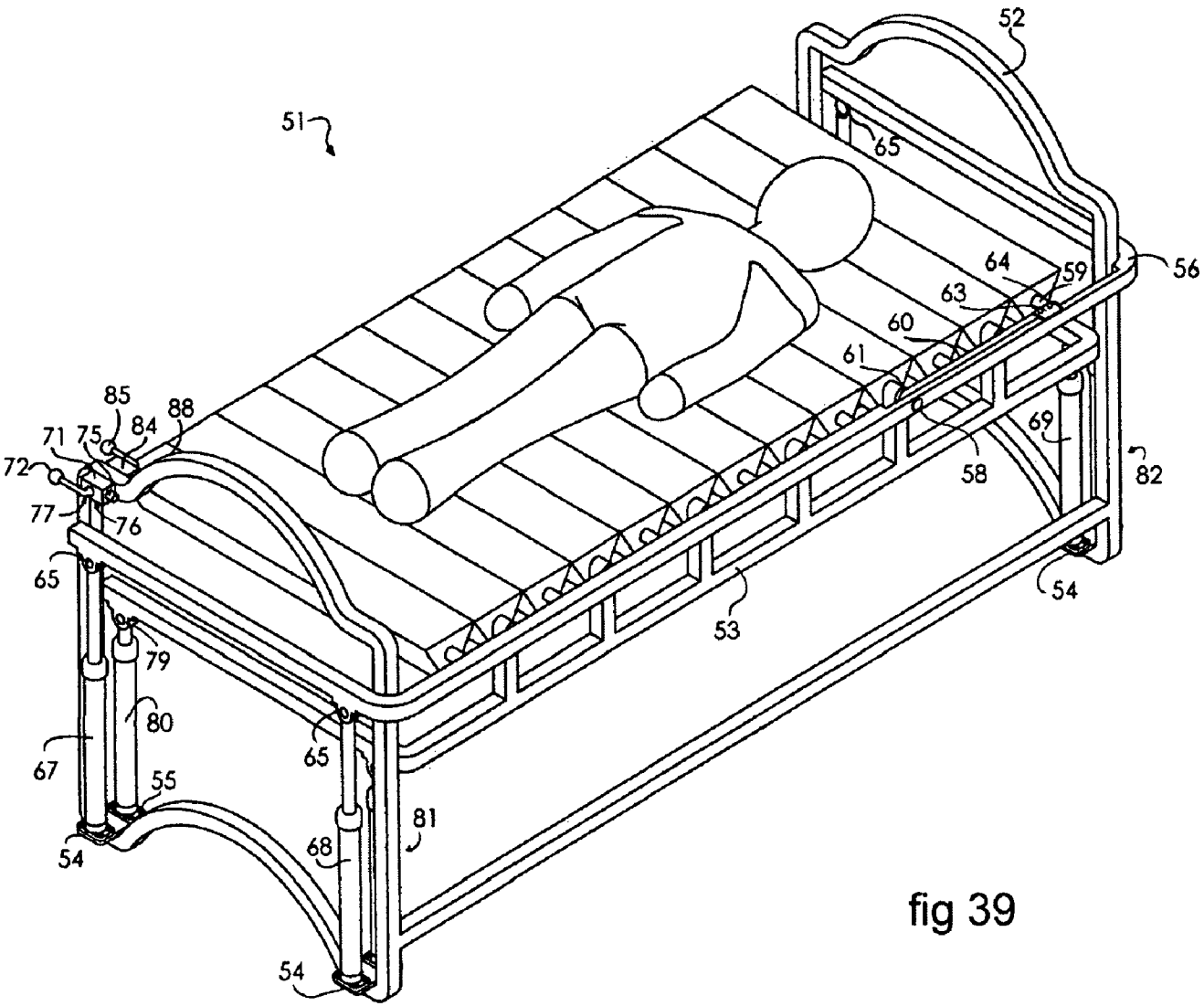
FIG. 39. Front perspective of pneumatic stationary bed (51) with a dummy lying on it FIG. 40. Front perspective of the structure, wheels and some planks of the pneumatic maneuverable bed (91)

With the Type B multi-purpose hospital beds, the change in position of the planks is by vertical movement instead of a rotational movement with rods as in Type A. This upwards or downwards vertical movement can be made possible with a manual jack, a motor, or a gear box. In this case, the system makes use of the pneumatic jack. What follows is a description of the parts:

(1) The Pneumatic Stationary Bed (FIG. 39)

Figure 31:
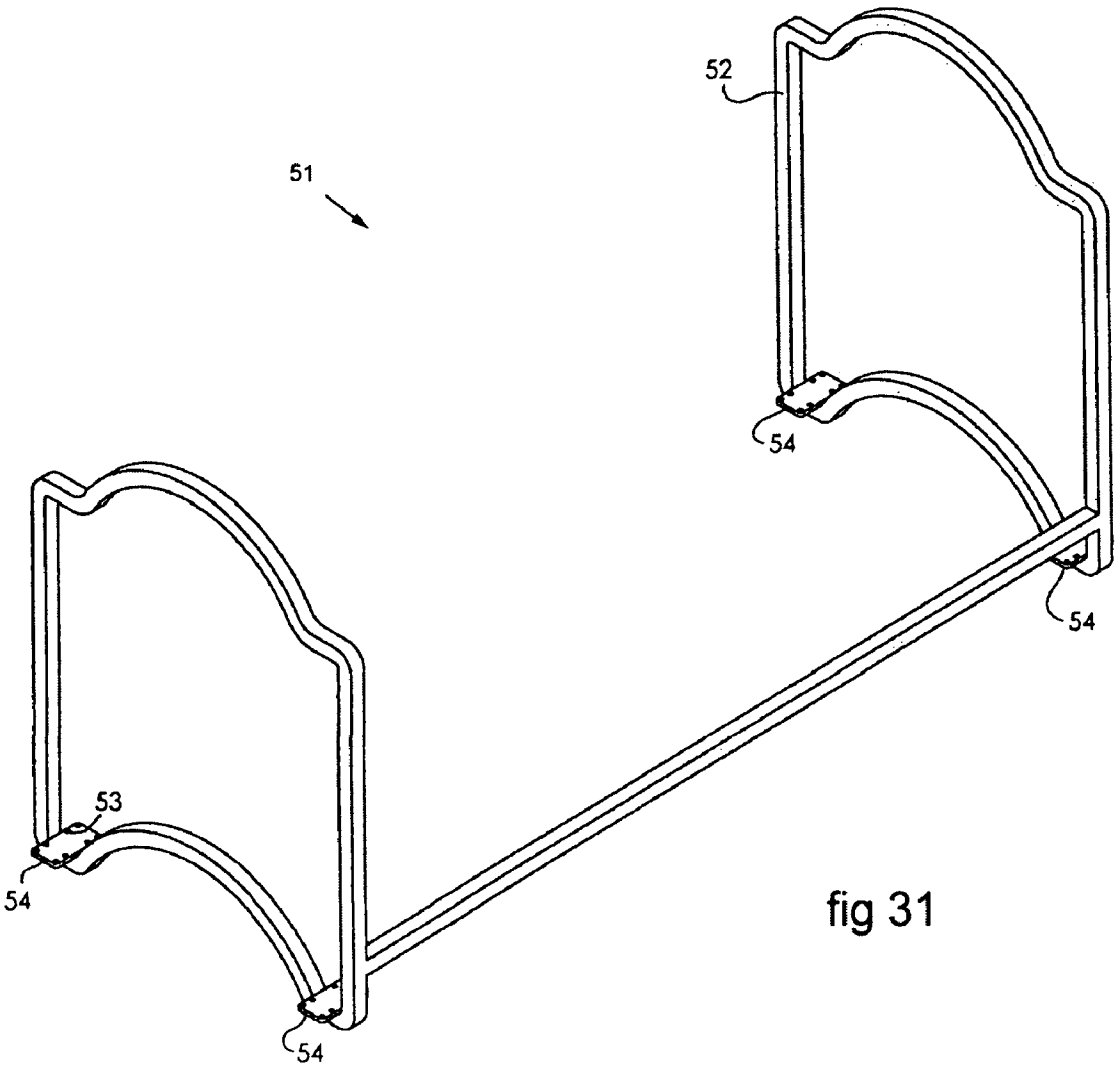

The base (FIG. 31) of the pneumatic stationary bed (52) is a structure to which other parts are attached. It has four recessed bed plates which hold the pneumatic jacks in place. On each plate are four holes (53) to fit in the screws attaching the pneumatic lack legs.

Figures 32, 33:
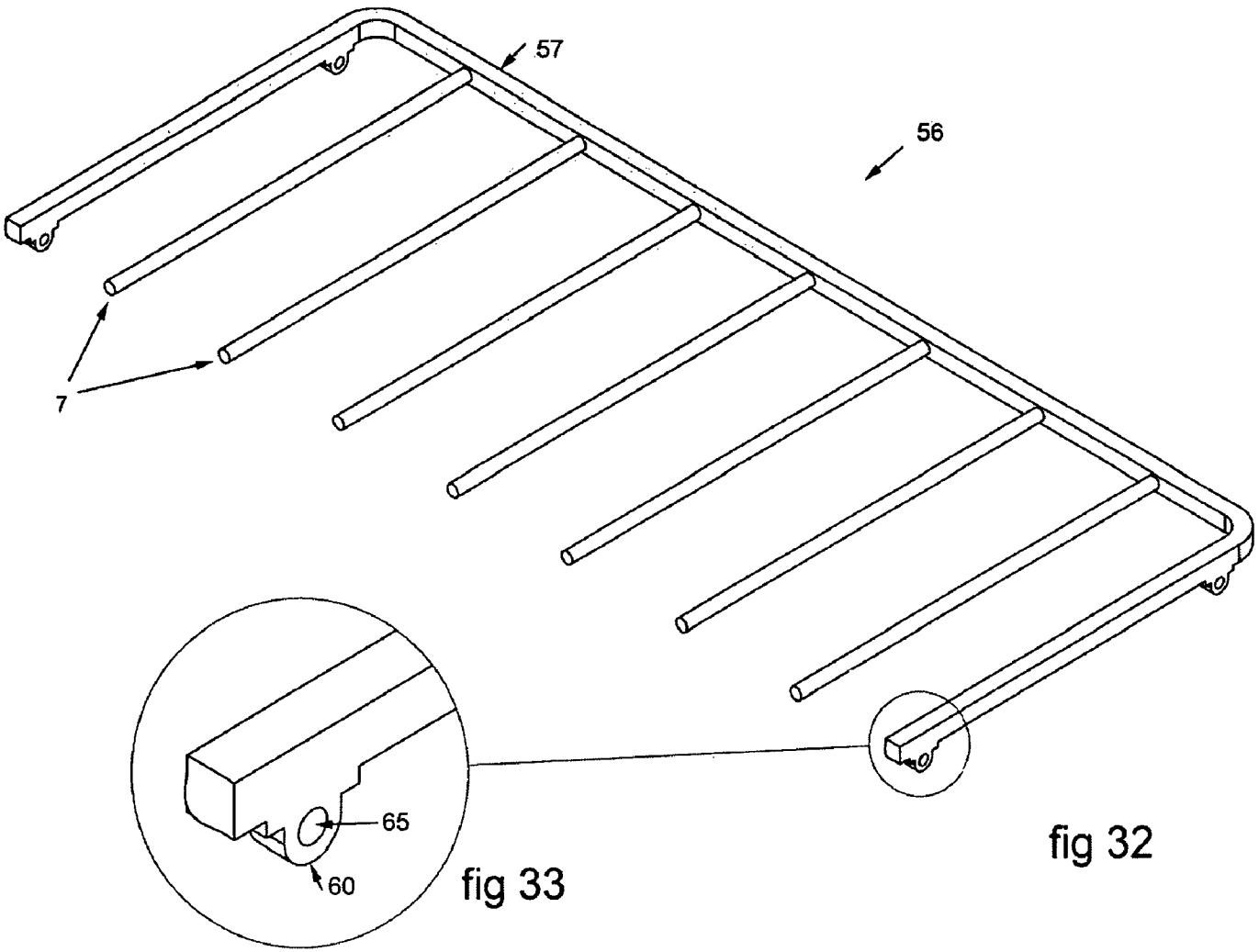
FIG. 32. Front perspective of palette number 56 of the pneumatic stationary bed FIG. 33. Enlarged front view of the position of hole number 65 and recessed bed plate number 60

The first of two palettes (FIG. 32) making up the pneumatic stationary bed (56) has a U-shaped frame (57) bearing four recessed bed plates (60) with holes (65) (FIG. 33). The pneumatic lack is screwed down to the palette (56) through hole number 65. This palette (56) has seven strong rods (59) whose ends are attached to the structure (57) while the opposite end (27) is free to enable the sliding in of the plank (FIGS. 4 & 5). On each rod end (27), there are 3 holes (14) angled equally (120 degrees) to each other to which the metal ball (8) bearing assembly on the hole of each plank is set to ensure the stable positioning of the plank on the rod and to prevent unwanted movements.

Figures 35, 36, 37, 38:
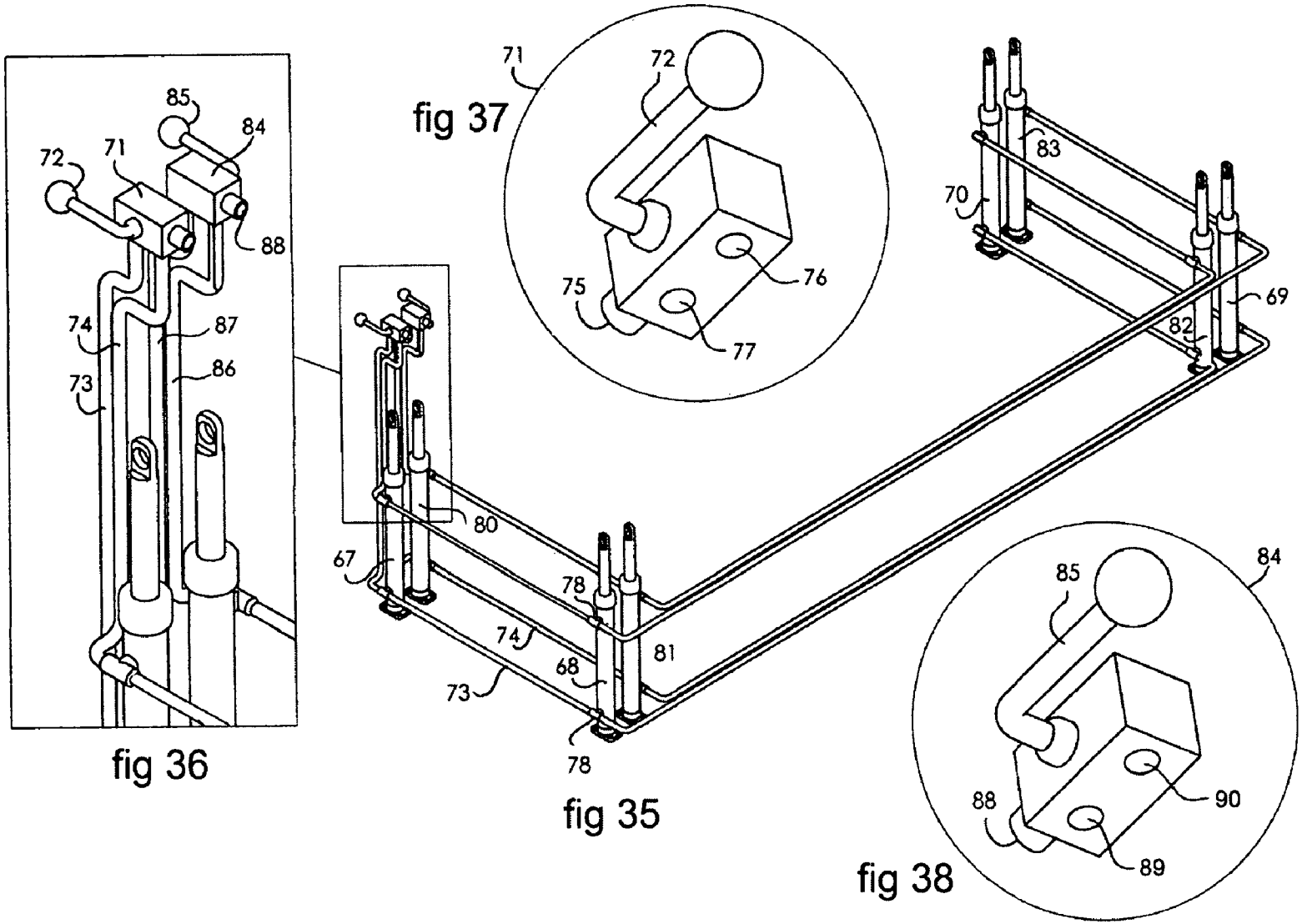
FIG. 38. Enlarged front view of tap numbering (85)

All in all, the first palette of the pneumatic stationary bed has four pneumatic jacks (67, 68, 69 and 70) which are screwed down to the base of the bed through recessed bed plates. Their function is to raise the palettes up and down in a vertical direction. Each jack has two air pressured inlets; and, when air pressure enters the inlet above the jack, the jack cylinder goes down but when air pressure enters the inlet under the jack, its cylinder goes up (FIG. 35).

A mechanical tap (71) with a control lever (72) is provided. It functions to route a determined amount of air pressure from the compressor to hoses (73 and 74). Moreover, this manual tap has one inlet hole (75) which connects to the air compressor and two outlet holes (76 and 77) as well. The lowering and raising of the control lever (72) allows air pressure to enter either exit hole number 76 or number 77 (FIG. 37).

There are connecting hoses to allow the routing of air pressure from the compressor to the manual tap thereby distributing air pressure to the four pneumatic jacks. Hose number 73 connects to inlet holes under the jacks (67, 68, 69 and 70) through a 3-way connector (78). Therefore, when the control lever (72) of the manual tap is raised, air pressure enters hose number 73 through outlet hole number 77 thus raising jacks numbering 67, 68, 69 and 70 which in turn allows the first palette (56) with its corresponding planks to go up. As for hose number 74, it connects to the inlet holes above the jacks (67, 68, 69 and 70) through a 3-way connector (78). When the control lever (72) of the manual tap is lowered, air pressure enters hose number 74 through hole number 76 thereby lowering pneumatic jacks numbers 67, 68, 69 and 70 which in turn makes palette number 56 together with its corresponding planks to go down.

Figure 34:
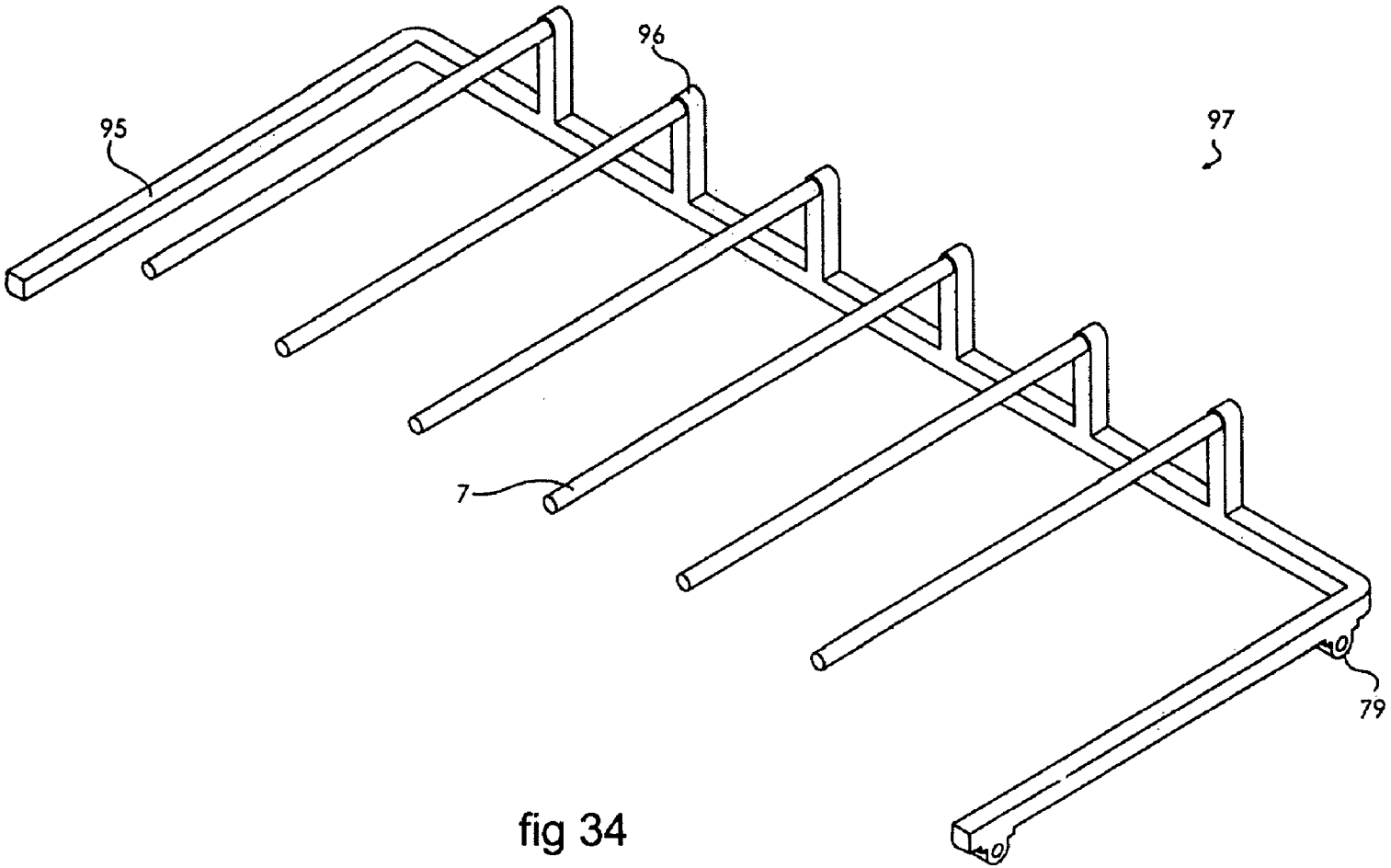
FIG. 34. Front perspective of palette number 97 of the pneumatic stationary bed FIG. 35. Front perspective of pneumatic circuit FIG. 36. Enlarged front view of pneumatic manual tap FIG. 37. Enlarged front view of tap numbering (71)

The second palette (FIG. 34) of the two palettes of the stationary pneumatic bed is a U-shaped structure (95) with six legs (96) attached to it wherein one end of each leg lies firmly on the structure while the other end is attached to corresponding rods (7) of the palette planks. These palette rods (7) are strong rods whose ends, as mentioned, are attached to the legs (96) on the structure while their opposite ends are free to allow the sliding in and out of the planks. On each rod end are three holes angled equally (120 degrees) to each other to which the metal ball (8) bearing assembly on the hole of each plank is set to ensure the stable positioning of the plank on the rod and to prevent unwanted movements. Also, there are four recessed bed plates (79) which hold the pneumatic jacks in place. On each plate are four holes (98) to fit in the screws attaching the pneumatic jack legs.

All in all, the second palette of the maneuverable bed has four pneumatic jacks (80, 81, 82 and 83) which are screwed down to the base of the bed and the palette through recessed bed plates. Their function is to raise the palettes up and down in a vertical direction. Each lack has two air pressured inlets; and, when air pressure enters the inlet above the lack, the lack cylinder goes down but when air pressure enters the inlet under the lack, its cylinder goes up.

Likewise, a mechanical tap (84) with a control lever (85) is provided to enable the routing of a determined amount of air pressure from the compressor to hoses (86 and 87). Moreover, this manual tap has one inlet hole (88) which connects to the air compressor and two outlet holes (89 and 90) as well. The lowering and raising of the control lever (84) allows air pressure to enter either exit hole number 89 or number 90 (FIG. 38).

The connecting hoses provided allow the routing of air pressure from the compressor to the manual tap thereby distributing air pressure to the four pneumatic jacks. Hose number 87 connects to inlet holes under the jacks (80, 81, 82 and 83) through a 3-way connector (78). Therefore, when the control lever (85) of the manual tap is lowered, air pressure enters hose number 87 through outlet hole number 90 thus raising jacks numbering 80, 81, 82 and 83 which in turn allows the second palette (53) with its corresponding planks to go up. As for hose number 86, it connects to the inlet holes above the jacks (80, 81, 82 and 83) through a 3-way connector (78). When the control lever (85) of the manual tap is raised, air pressure enters hose number 86 through hole number 89 thereby lowering pneumatic jacks numbers 80, 81, 82 and 83 which in turn makes the second palette together with its corresponding planks to go down.

Figure 41:
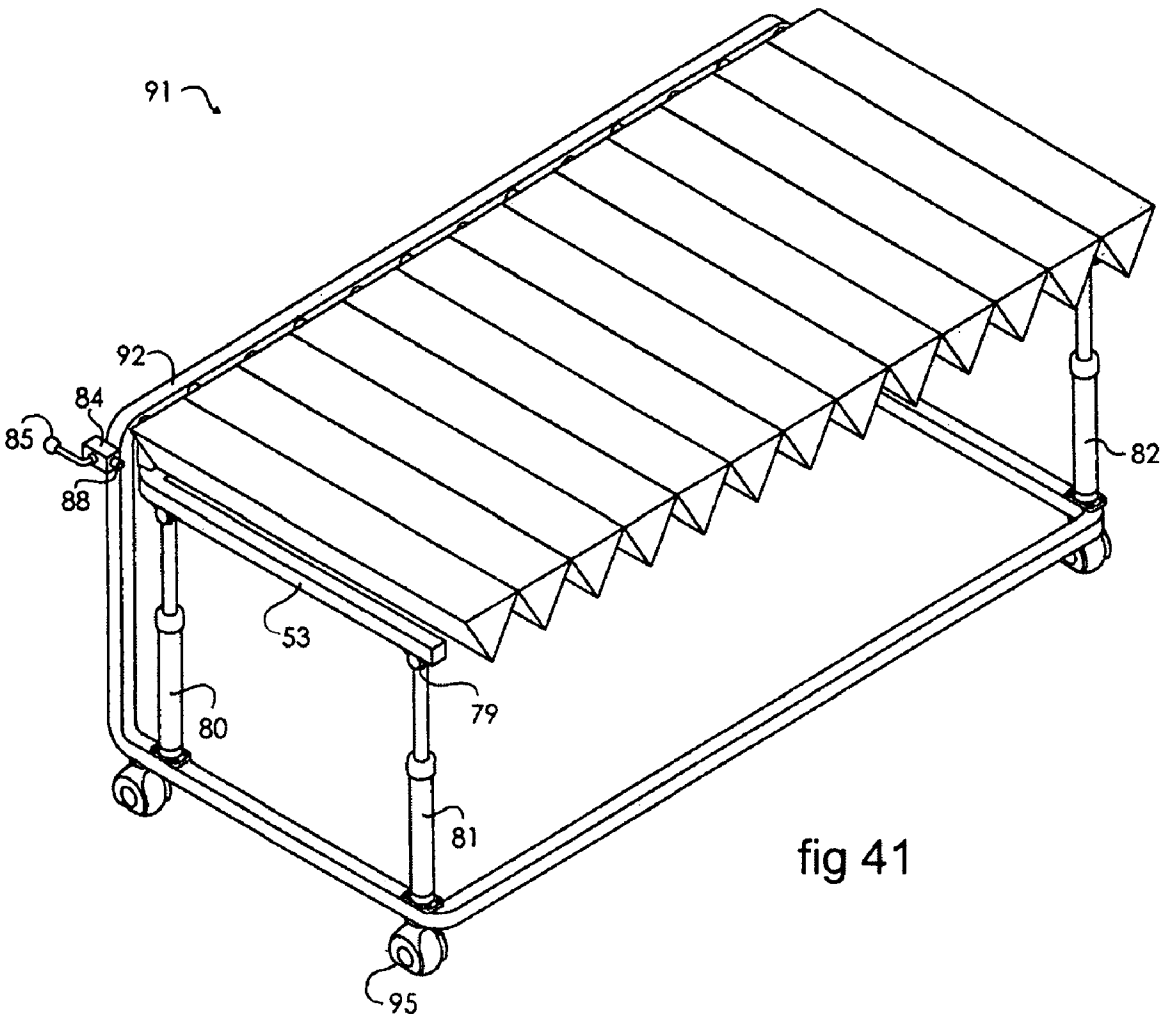
FIG. 41. Front perspective of the pneumatic maneuverable bed (91)
Figure 42:
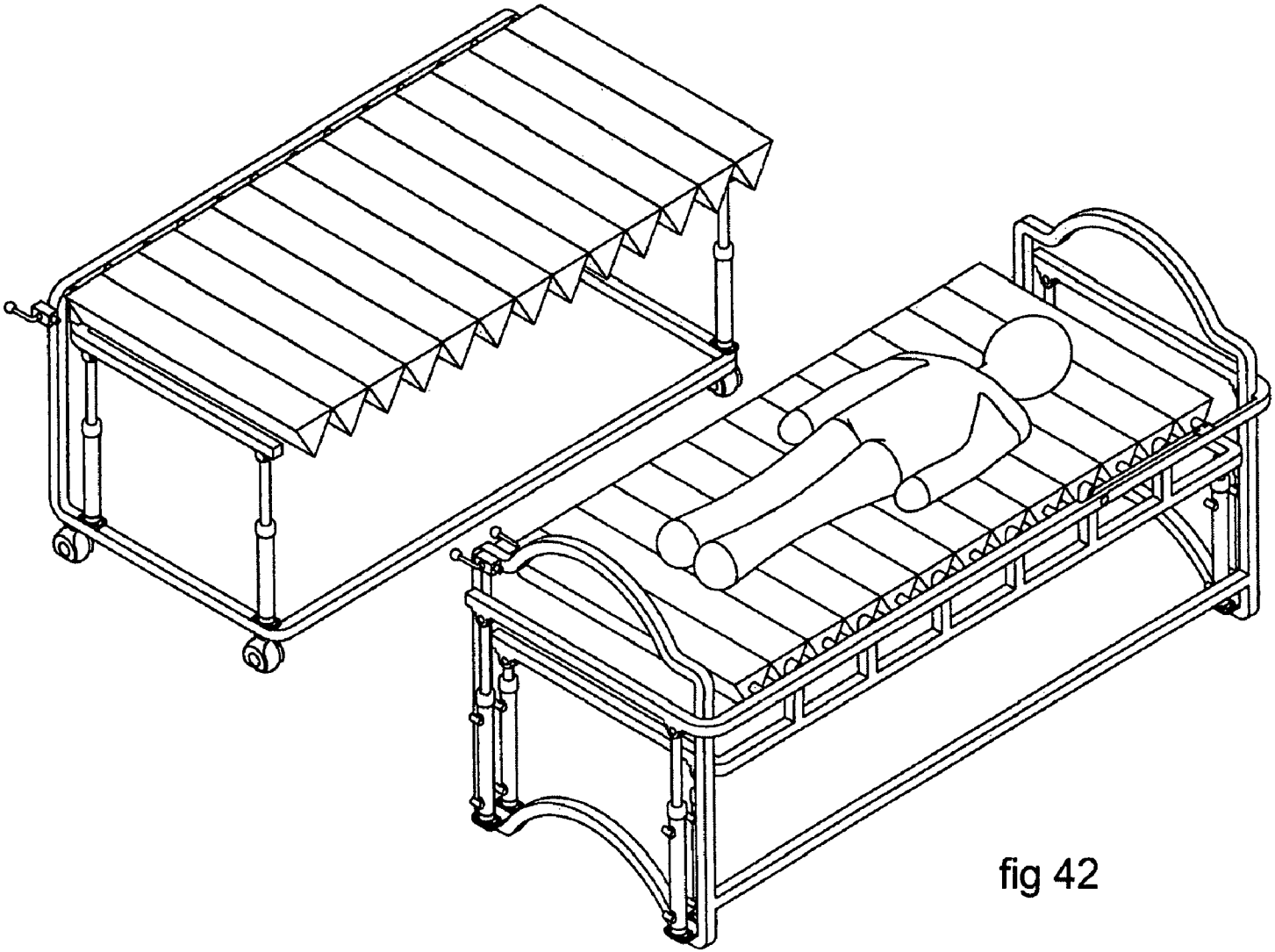
FIG. 42. This front view shows the pneumatic stable and maneuverable beds with a dummy patient lying on the pneumatic stationary bed to be transferred onto the pneumatic maneuverable bed FIG. 43. The first and second palettes of the stationary bed are adjusted to a reasonable height with the use of a manual lever of the mechanical tap and pneumatic jacks FIG. 44. The second palette of the maneuverable bed is adjusted to a reasonable height with the use of a manual lever of the mechanical tap and pneumatic jacks FIG. 45. The maneuverable bed goes into the stationary bed FIG. 46. The height level of the planks has been adjusted in such a way that they do not come into contact with each other when one is positioned alongside another FIG. 47. The first palette of the stationary bed is lowered and the dummy patient now lies on the first palette of the maneuverable bed FIG. 48. Front perspective of the two beds with the dummy patient lying on the first palette of the maneuverable bed FIG. 49. The maneuverable bed is taken away from within the stationary bed FIG. 50. The second palette of the maneuverable bed is raised up to a point that it is at the same level with its first palette FIG. 51. Front view and cross-section of air sac (101) with interior view. There is no compressed air inside the air sacs FIG. 52. Front view and cross-section of air sac (101) with interior view. There is compressed air inside the air sacs FIG. 53. Front perspective and cross-section of air sac (101) with interior view. There is no compressed air inside the air sacs FIG. 54. Front perspective and cross-section of air sac (101) with interior view. There is no compressed air inside the air sacs FIG. 55. Front perspective of air sac (101)
Figure 43:
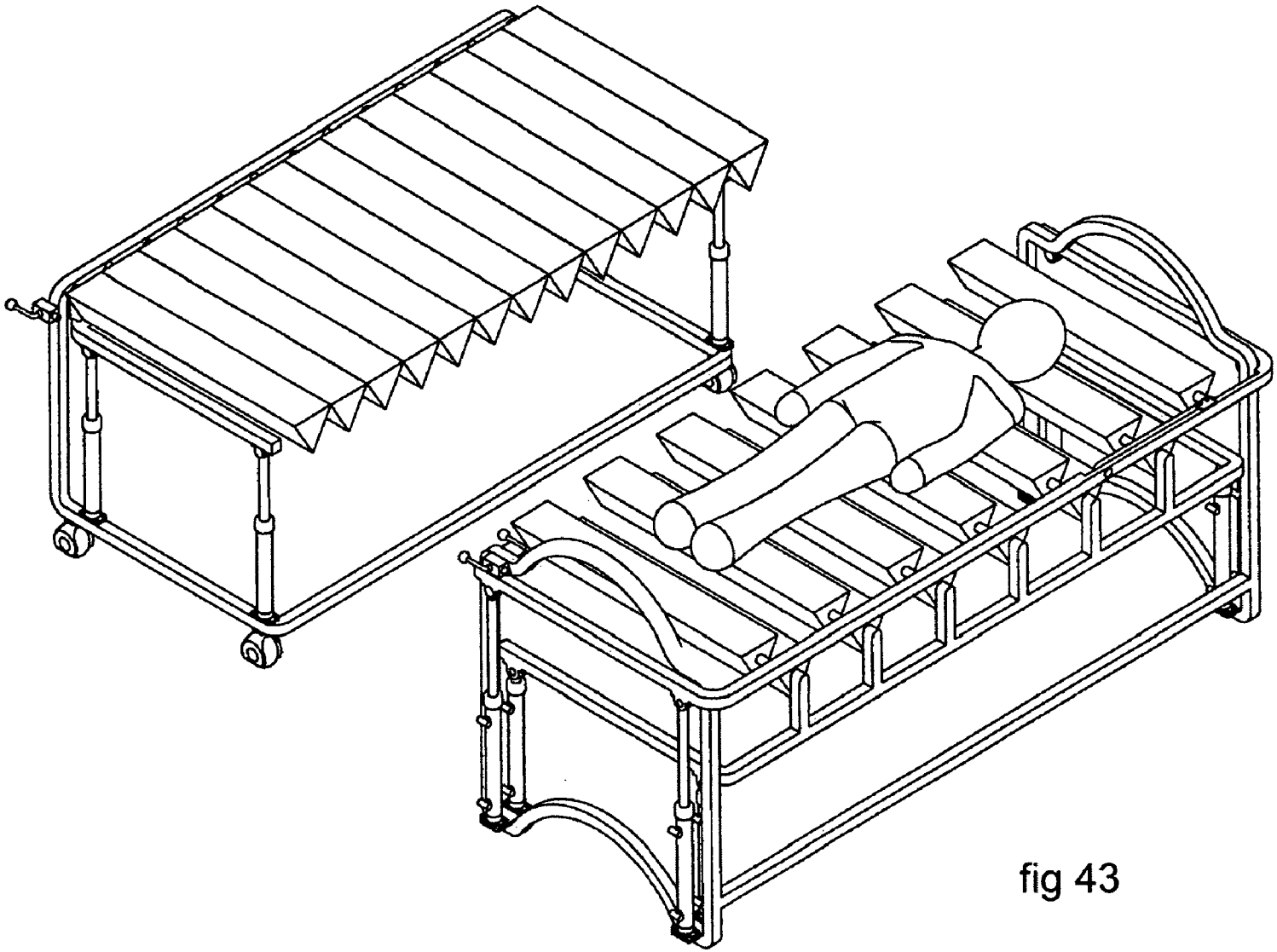
Figure 44:
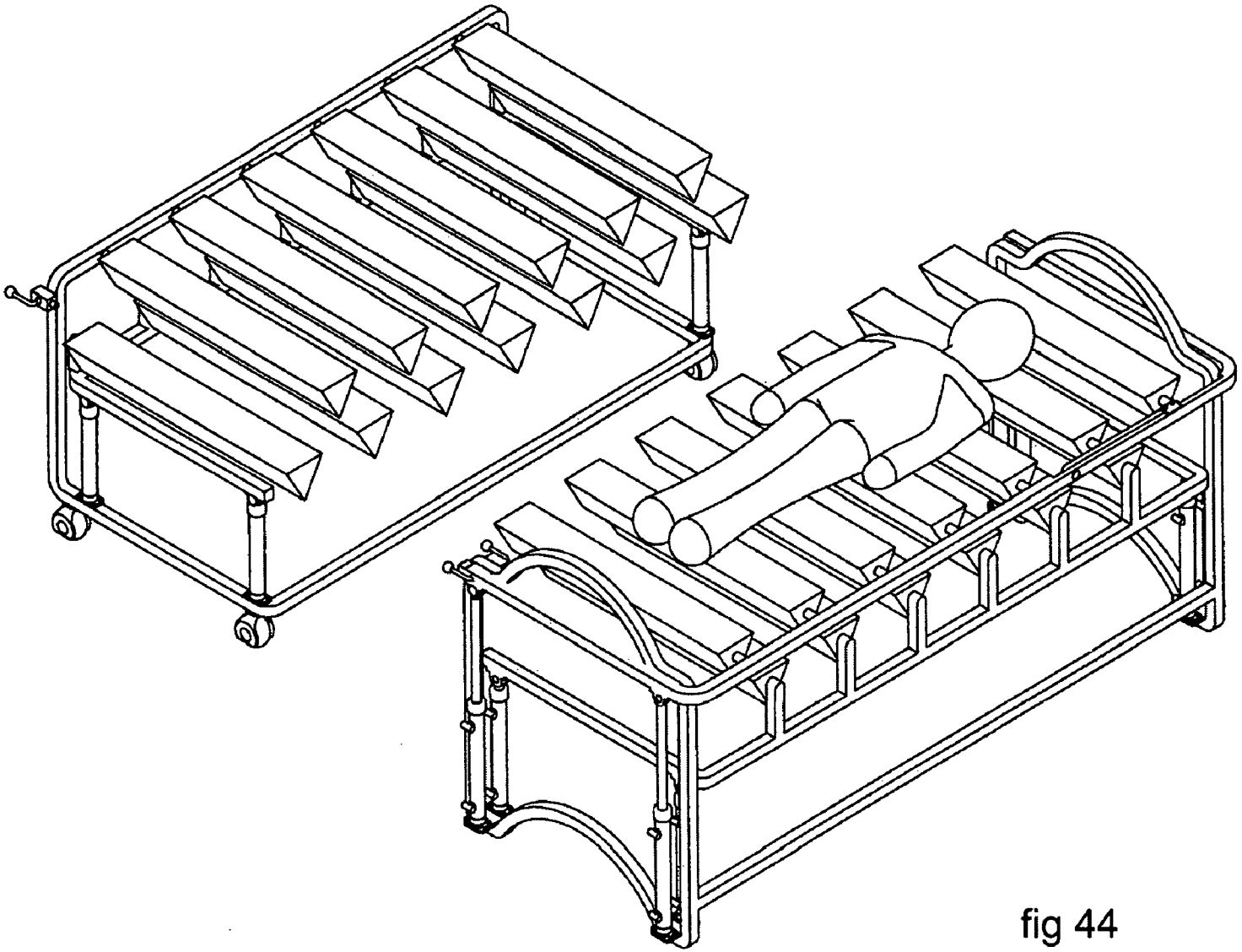
Figure 45:
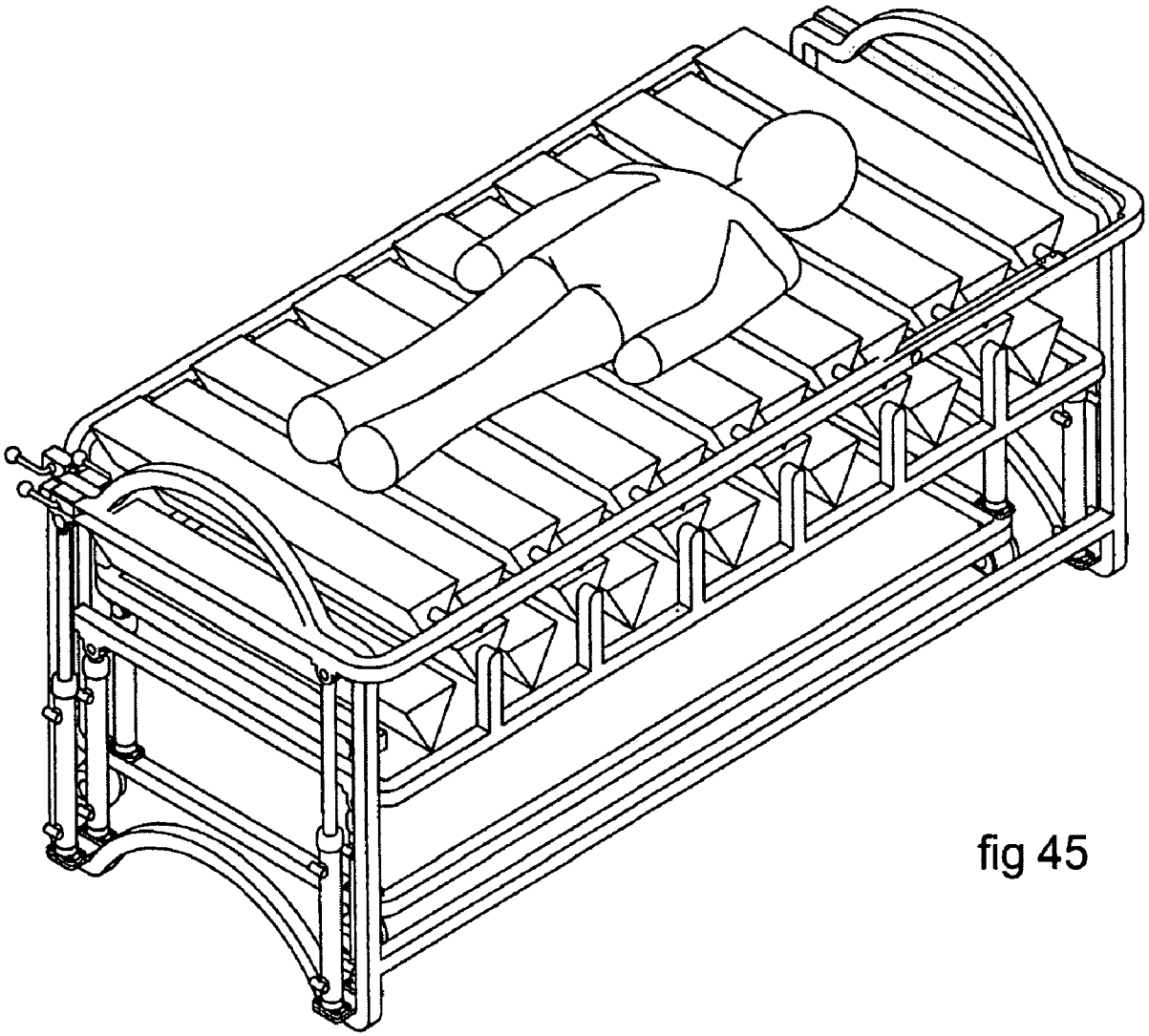
Figure 46:
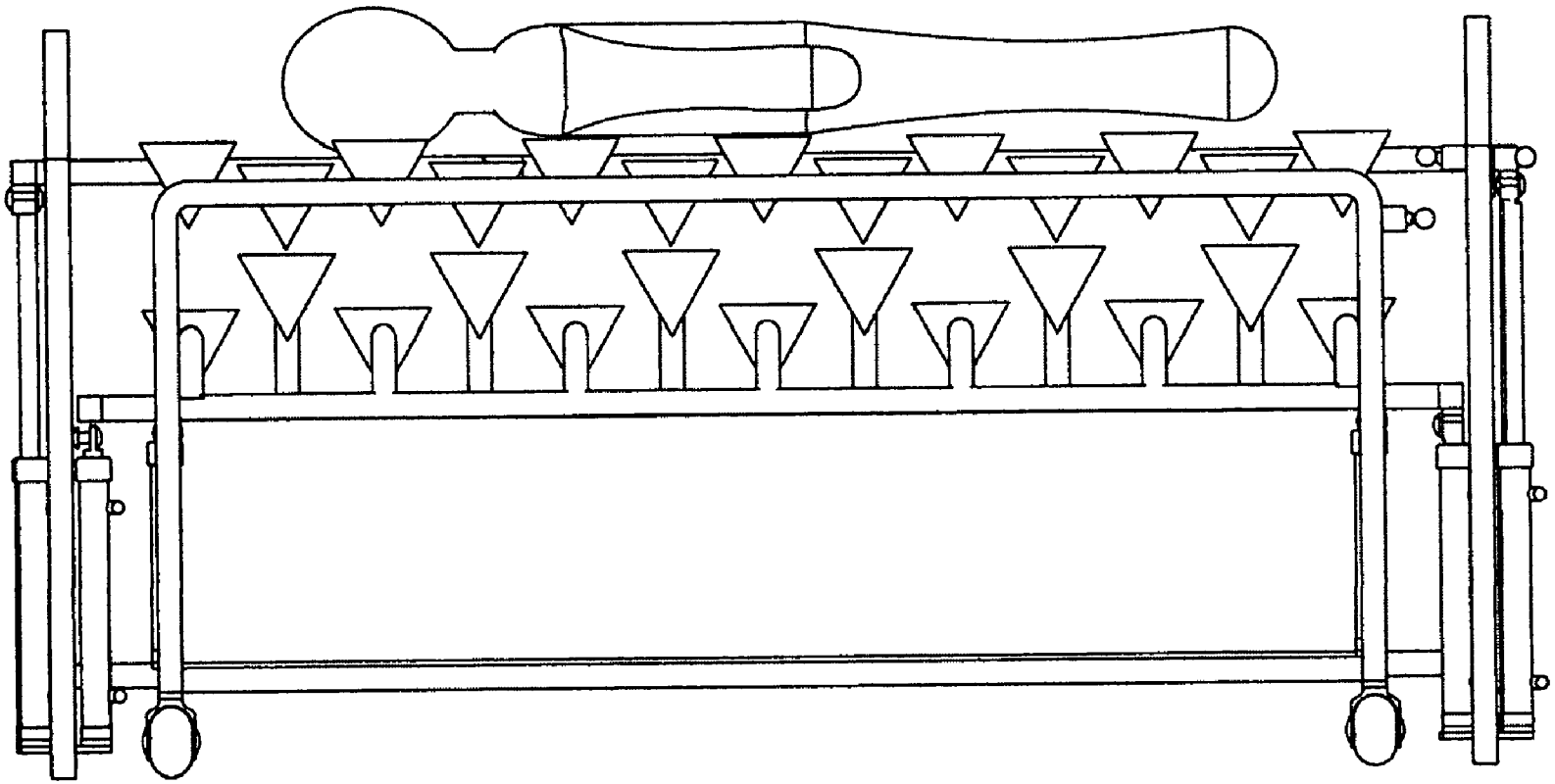
Figure 47:
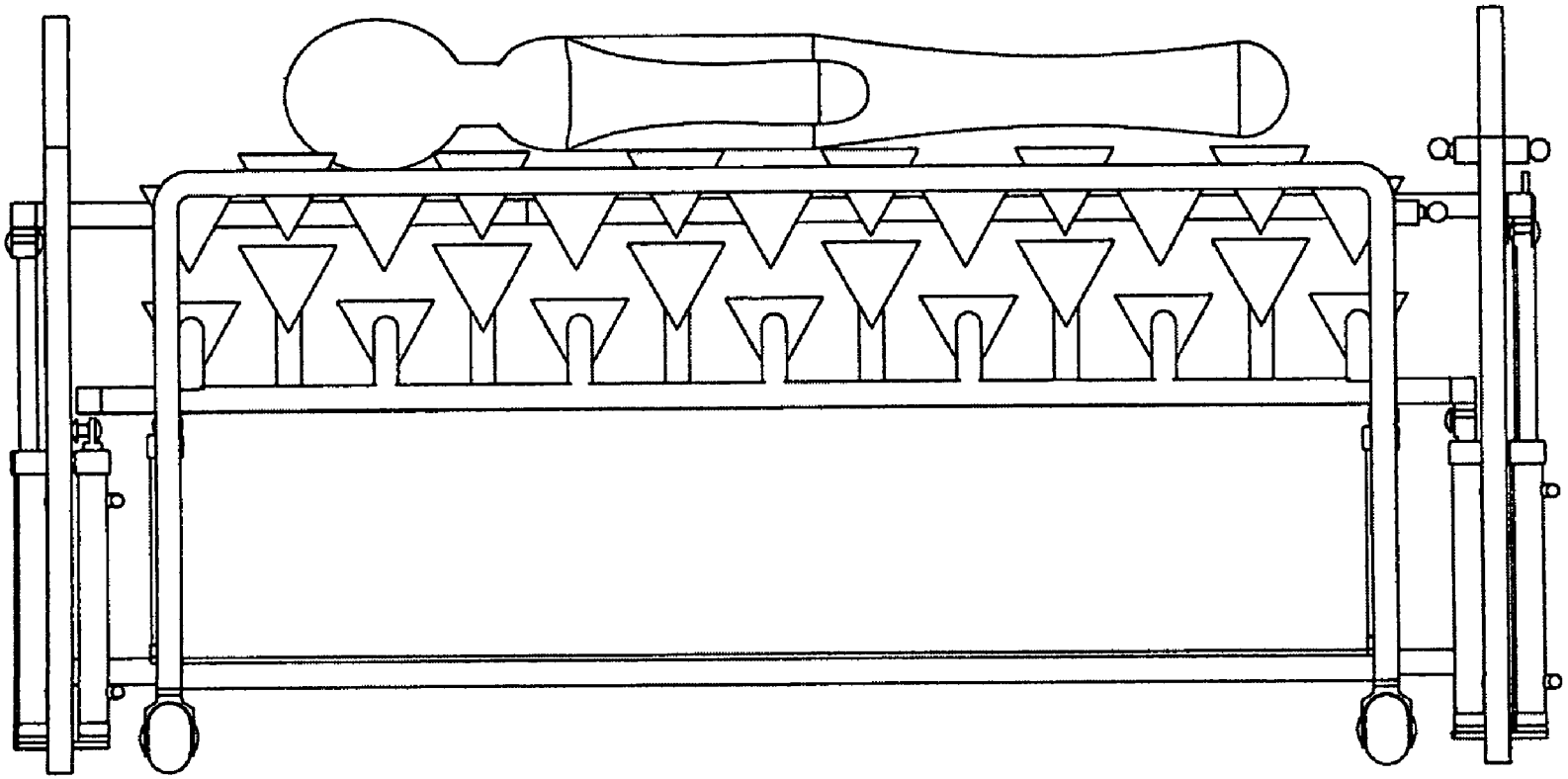
Figure 48:
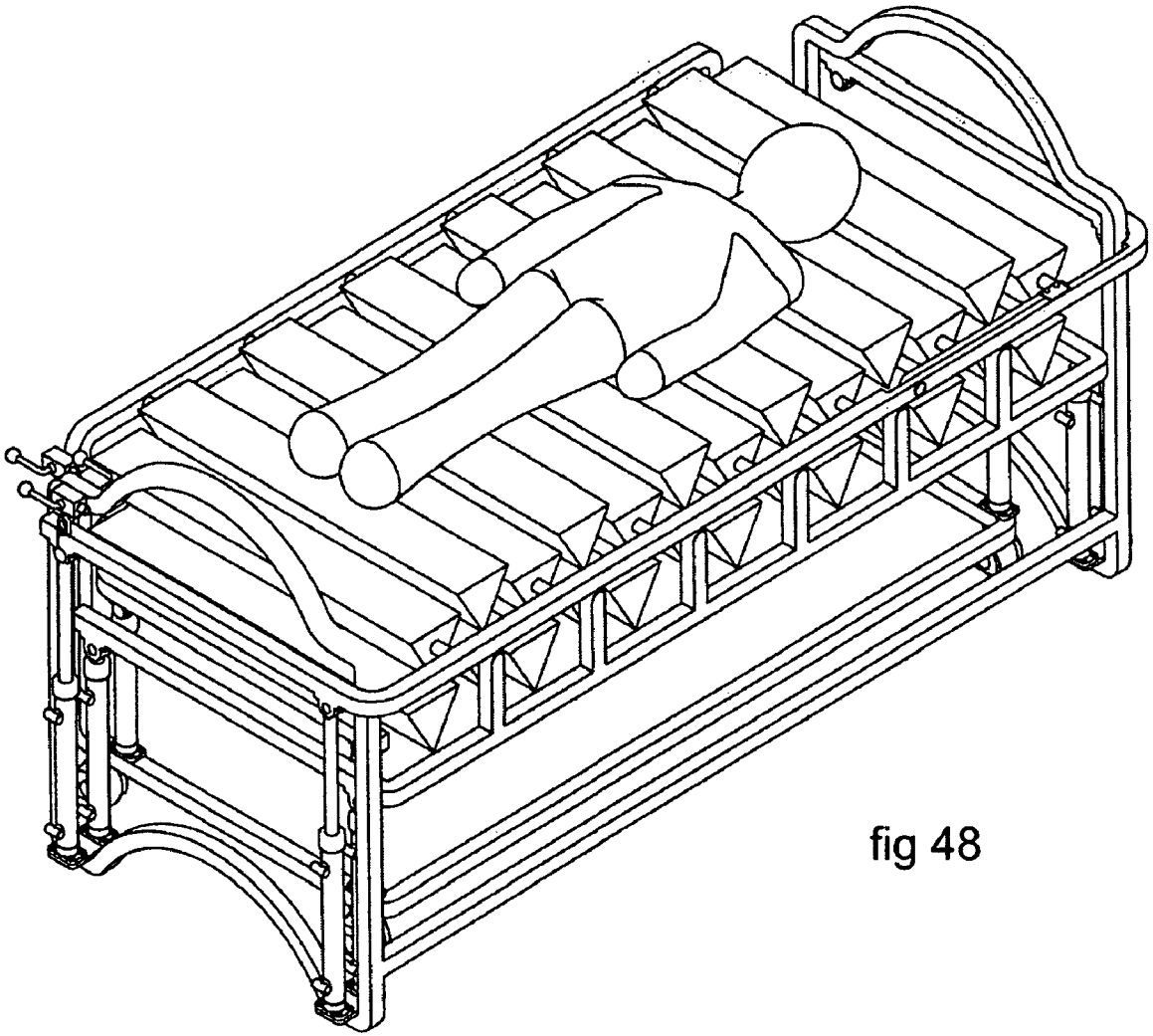
Figure 49:
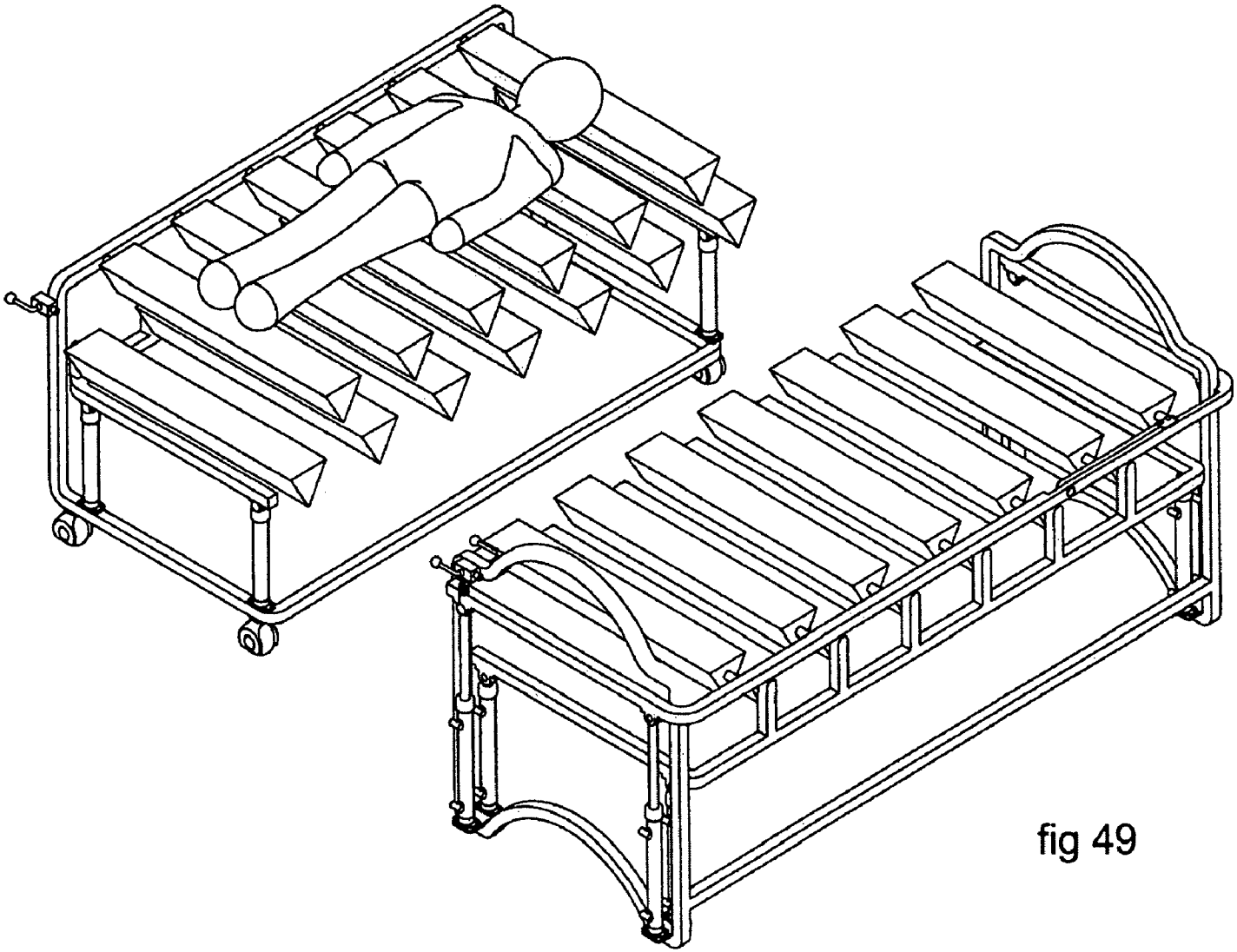
Figure 50:
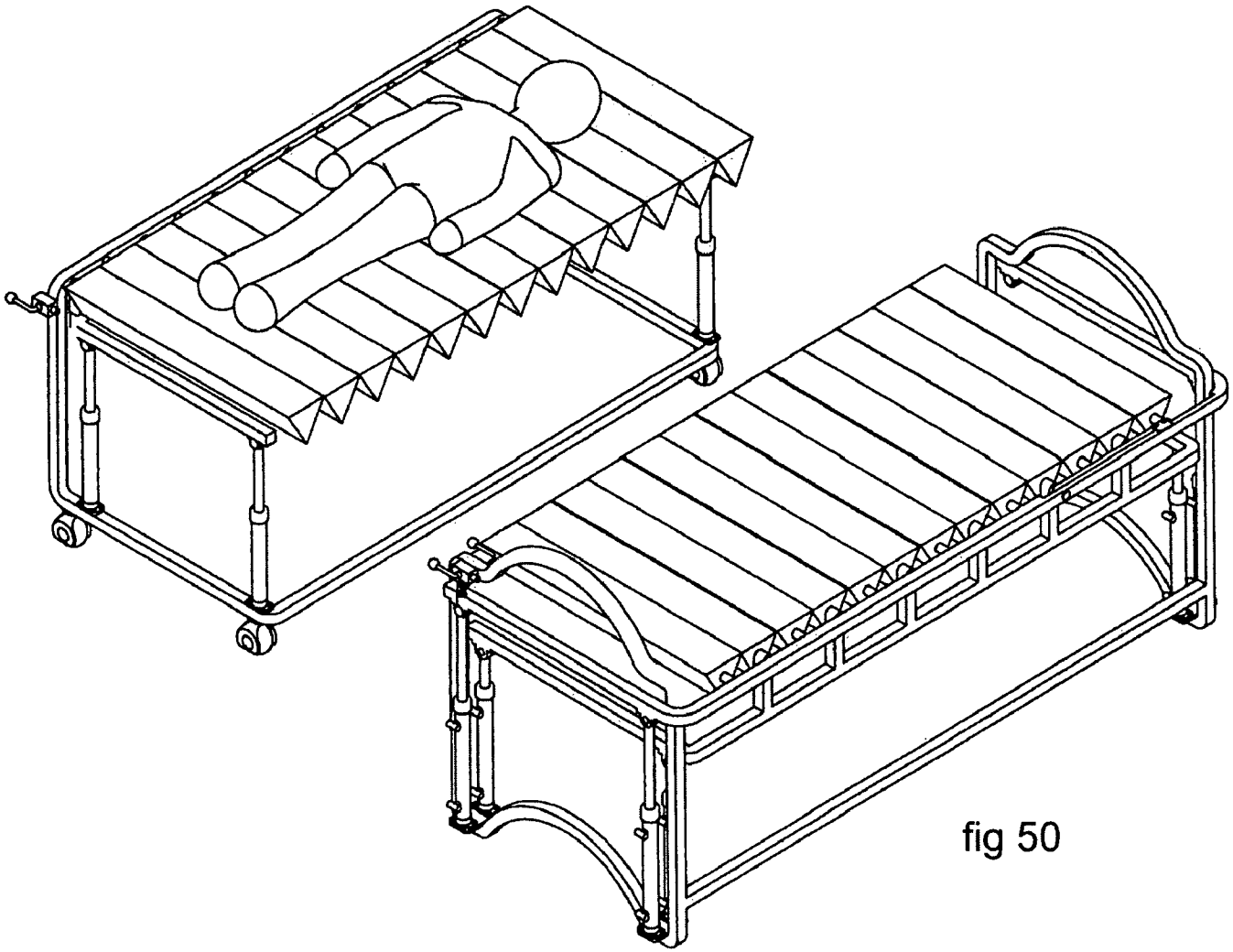
Figure 52:
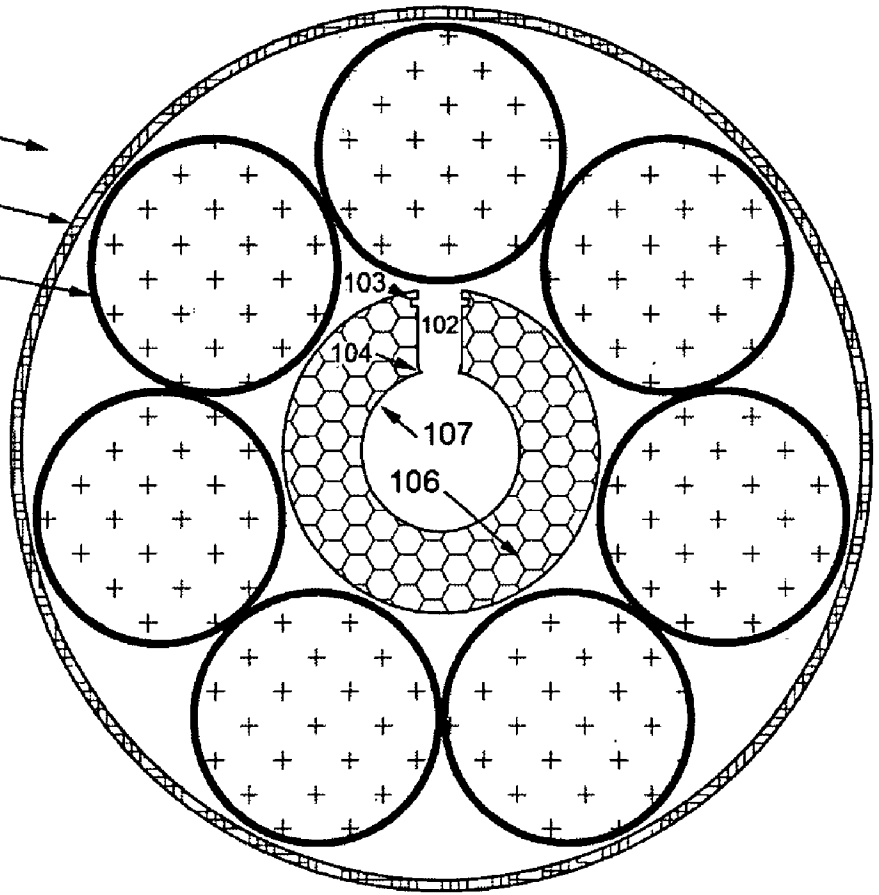
Figure 51:
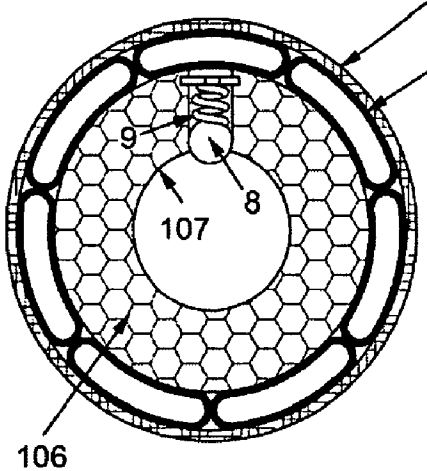
Figures 53, 54:
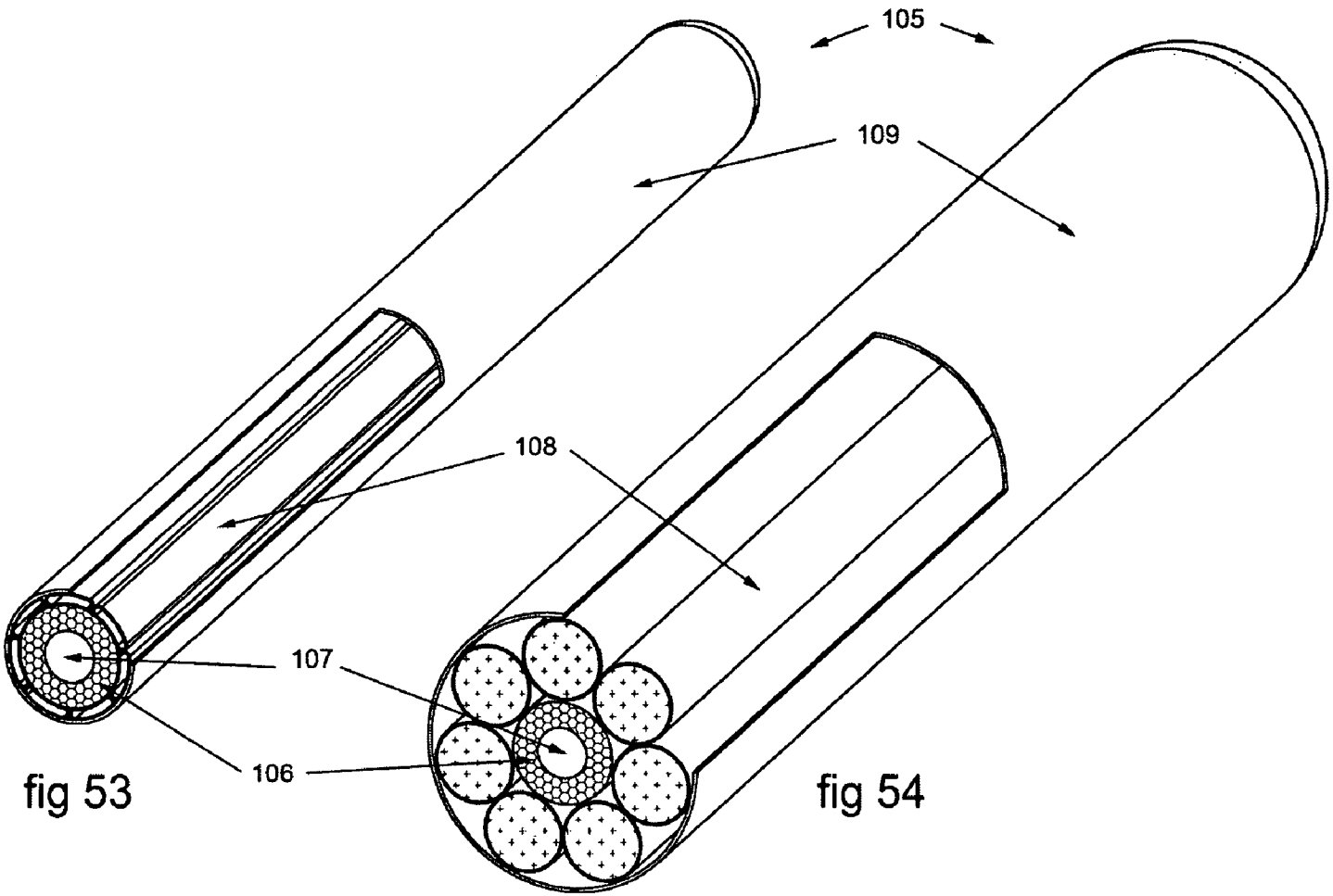
Figures 55, 56, 57, 58:
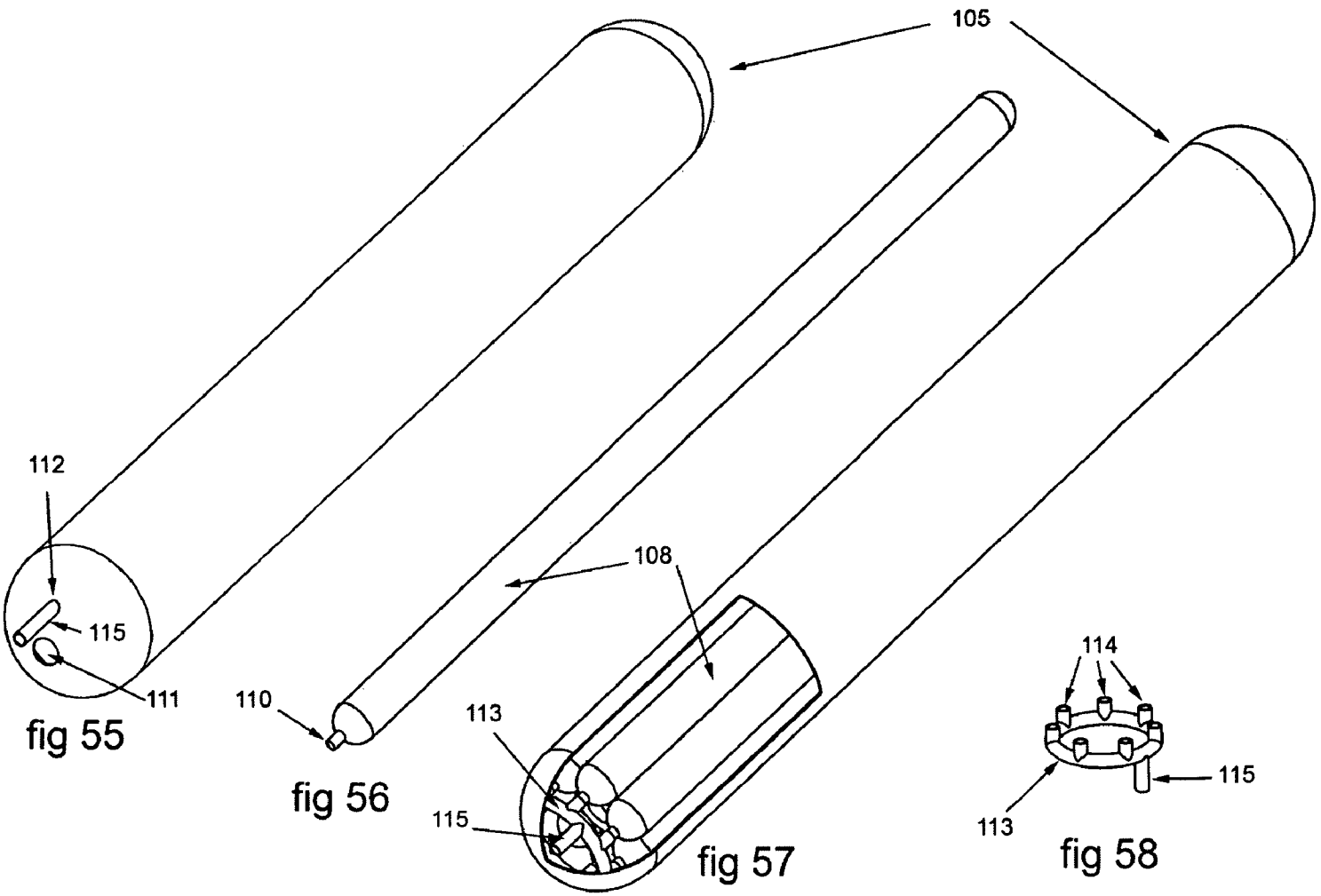
FIG. 56. Front perspective of air tube (108)
FIG. 57. Front perspective and cross-section of air sac (101) with interior view. In this diagram, the position of the divider (113) is shown FIG. 58. Front perspective of the divider (113)

(2) The Pneumatic Maneuverable Bed (FIG. 41)

Figure 40:
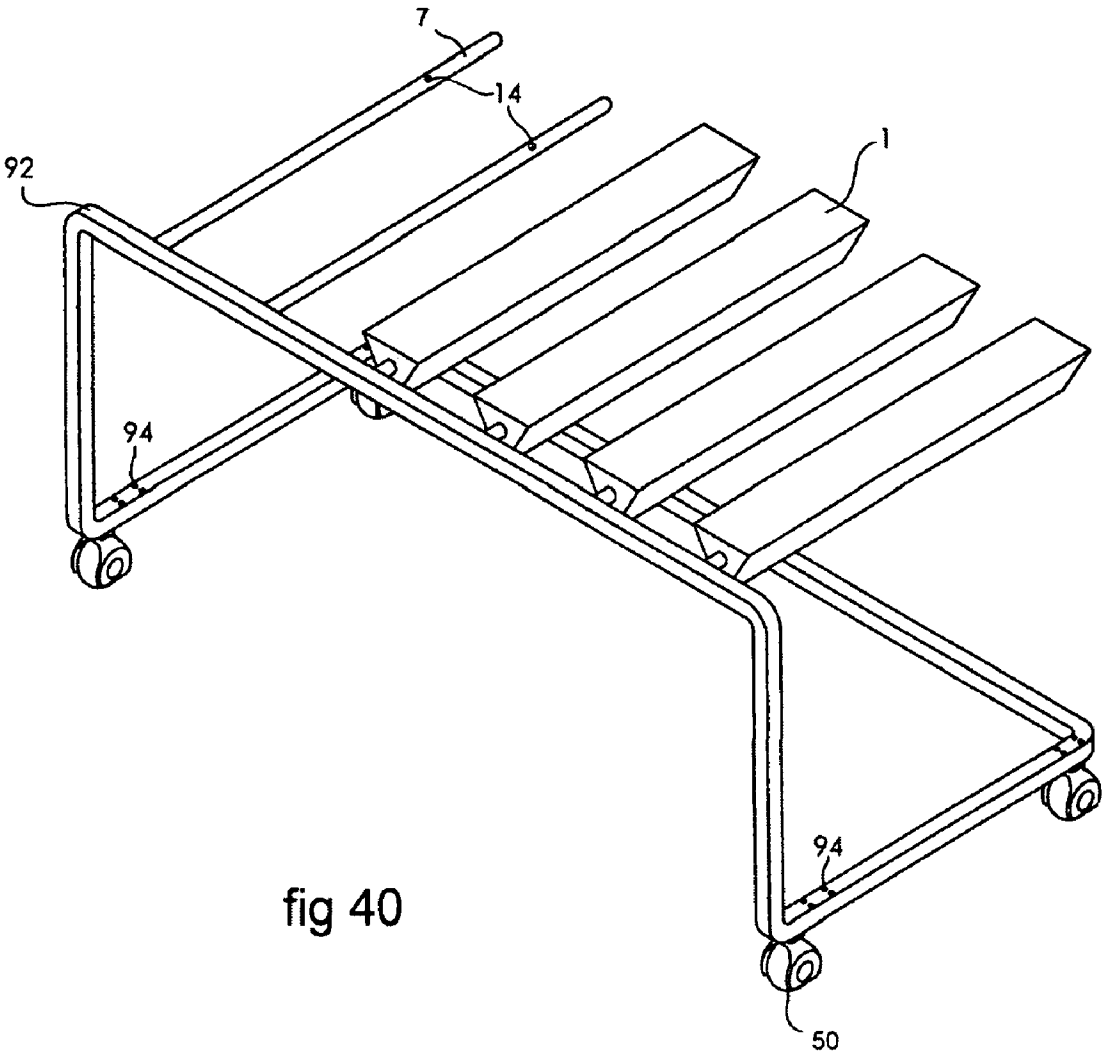

The base (FIG. 40) of the pneumatic maneuverable bed is a strong structure (92) to which other parts are attached such as the six plank rods (7) of the first palette whose ends are positioned firmly onto the structure while their opposite ends are free to allow the sliding in and out of the planks. On each rod end are three holes angled equally (120 degrees) to each other to which the metal ball (8) bearing assembly on the hole of each plank is set to ensure the stable positioning of the plank on the rod and to prevent unwanted movements. Also, there are four recessed bed plates which hold the pneumatic jacks in place. On each plate are four holes (94) to fit in the screws attaching the pneumatic lack legs. Moreover, the pneumatic maneuverable bed has four wheels (50) to enable the bed to move freely and thereby allow the convenient transfer of patients from one section to another in any hospital establishment.

The second palette (FIG. 34) of the pneumatic maneuverable bed is exactly the same as the second palette of the pneumatic stationary bed with similar specifications where the pneumatic jacks, the manual tap, and the connecting hoses are concerned (See above for its detailed explanation).

Type C

With the Type C hospital beds, the surface of the beds are divided into sections lust like the Type A and Type B beds; however, unlike the latter types where planks make up the surface of the beds and are alternatively taken away from and moved towards a patient's back, Type C uses a system of air sacs which are permanently positioned on the bed structure. By regulating the air content of the sacs of one bed, their volume can be reduced; thereby reducing size. With the reduction of the size of the air sacs, necessary space is freed to allow air sacs of the other bed to fill these empty spaces. The Type C multi-purpose hospital bed is actually made of two beds: the stationary and the maneuverable.

Figure 61:
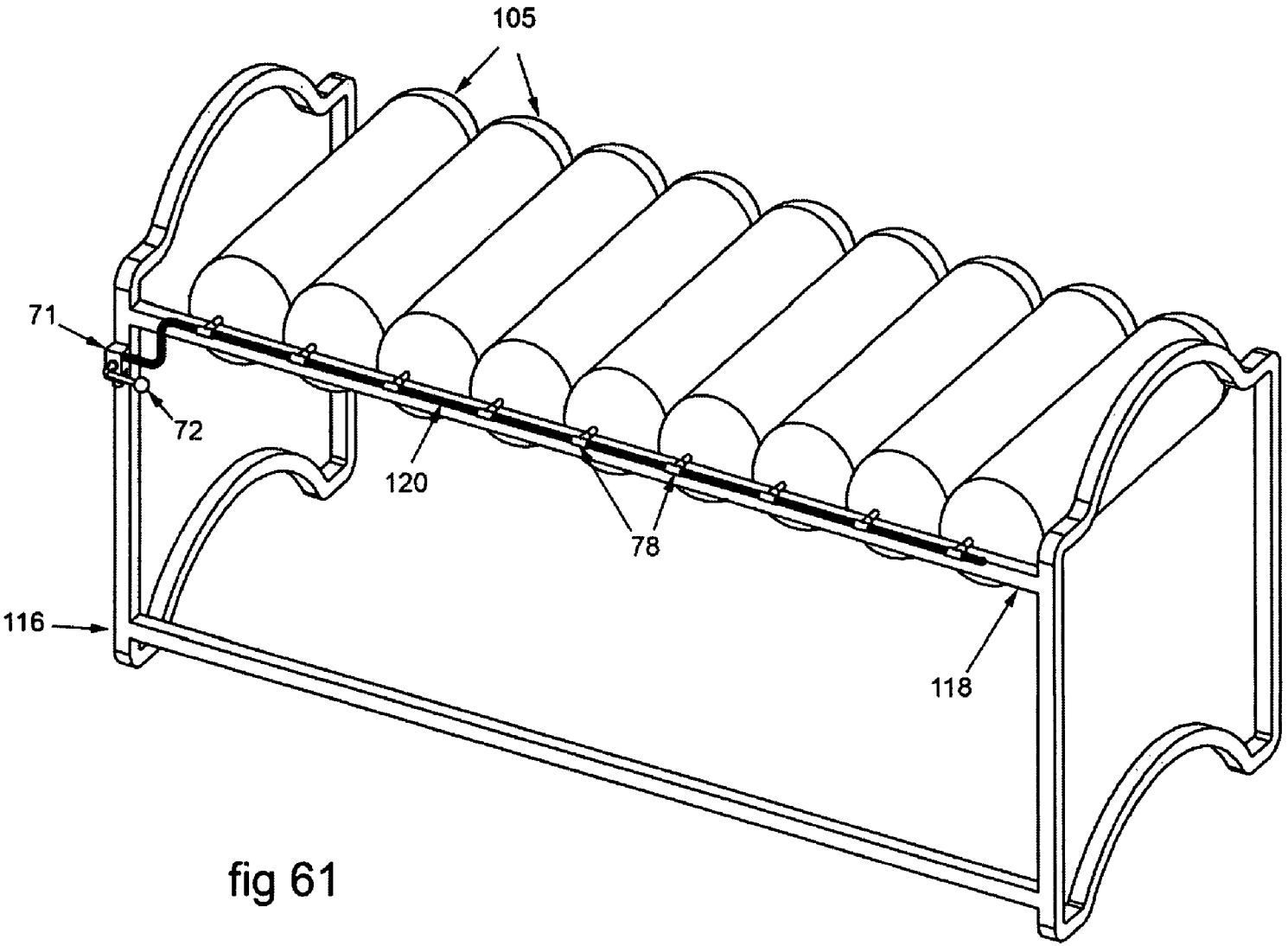
FIG. 61. Front perspective of all parts of the stationary bed showing the position of the control tap (71) and the connecting hose (120)

(1) The Stationary Bed (FIG. 61)

The stationary bed of Type C is composed of the following parts: the air sacs (101), the structure (116), the manual lever and the connecting hose (120). What follows is a detailed description.

The air sacks (FIGS. 51-58) are made of:

A. Base Center (106)

The base center is made of a hard solid material with a hole (107) in the center which plays a part in the rotating function. The air sacs are attached to the palette axle rod (7) from this hole. To prevent the air sacs from moving loosely or from falling out of the palette rod, a ball bearing assembly has been put in place wherein a spring (9) and a round metal ball (8) inside a hole (102) is positioned over the base center (3). A groove (103) in the upper part of the hole keeps a curved metal spring (12) in place to prevent the spring from being dislodged from the hole. Likewise, an indention (104) below the hole keeps the metal ball in place. On the palette axle rod are three holes (14) to which the metal ball falls in place to allow rotation and the removal of the air sacs from the palette rod. This mechanism has been designed in such manner that the air sacs while locked in any three positions can rotate 120 degrees.

B. Air Tubes (108)

The air tubes are cylindrical sacks which are elastic and these can be found positioned around the base center. When compressed air enters the tubes through inlet hole number 110, their volume increases; and, when compressed air is emptied from the tubes, their volume decreases and thus, the tubes would then rest on the base center.

C. Divider (113)

A divider (FIG. 58) has been provided so that each air tube is attached to one part of it. This divider functions to route compressed air to all the air tubes simultaneously. There are outlet holes (114) on the divider which connects to the hole number 110 of the air tubes. Compressed air enters the divider through inlet holes (115) and from the outlet holes (114) enters the air tubes.

D. Temporary Cover (109)

A textile material covers all around each air sac. This sheet protects the air sac from being contaminated and dirtied; however, it is temporary and can easily be replaced when necessary. On the sheets are holes (111) through which the axle palette rod (7) is passed and other holes (112) through which are passed the inlet holes of the divider (115).

Figure 59:
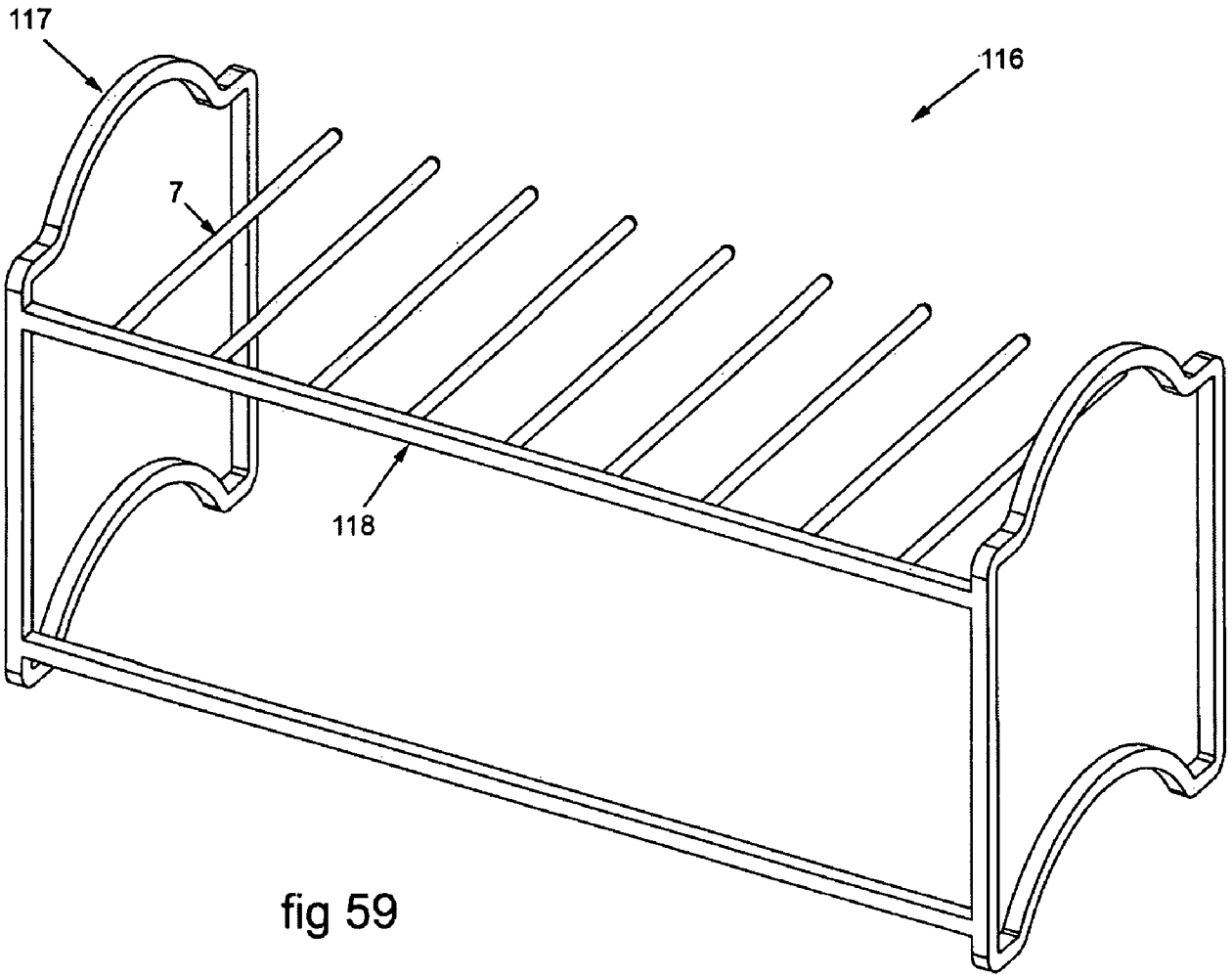
FIG. 59. Front perspective of the structure of the stationary bed (116)

As for the base (FIG. 59) of the stationary bed, it is a strong structure (116) made of hard durable material with an arch (117). There are nine rods (7) attached to the axle rod (118); each being a strong rod with one end (26) resting on the axle rod (118) while its opposite end (27) is free to enable the sliding in of each air sac. On each rod end (27), there are 3 holes (14) angled equally (120 degrees) to each other to which the metal ball (8) bearing assembly on the hole of each air sac is set to ensure the stable positioning of the air sac on the rod and to prevent unwanted movements.

With regards to the manual lever (72), it serves as the handle of a mechanical tap (71) (FIG. 37) which functions to route compressed air to the air tubes inside the air sacs through connecting hose number 120. This sort of control tap has an inlet hole (75) which connects the tap to the air compressor as well as two outlet holes (76 and 77). When the lever (72) is raised, compressed air enters the air sacs through outlet hole number 76 and when the lever (72) is lowered, compressed air exits the air sacs through outlet hole number 77.

Finally, there is a connecting hose (120) (FIG. 61) which functions in routing compressed air from the mechanical control tap (71) to the air sacs. There are 3-way connectors provided so that air is distributed simultaneously and equally to all the air sacs.

Figure 60:
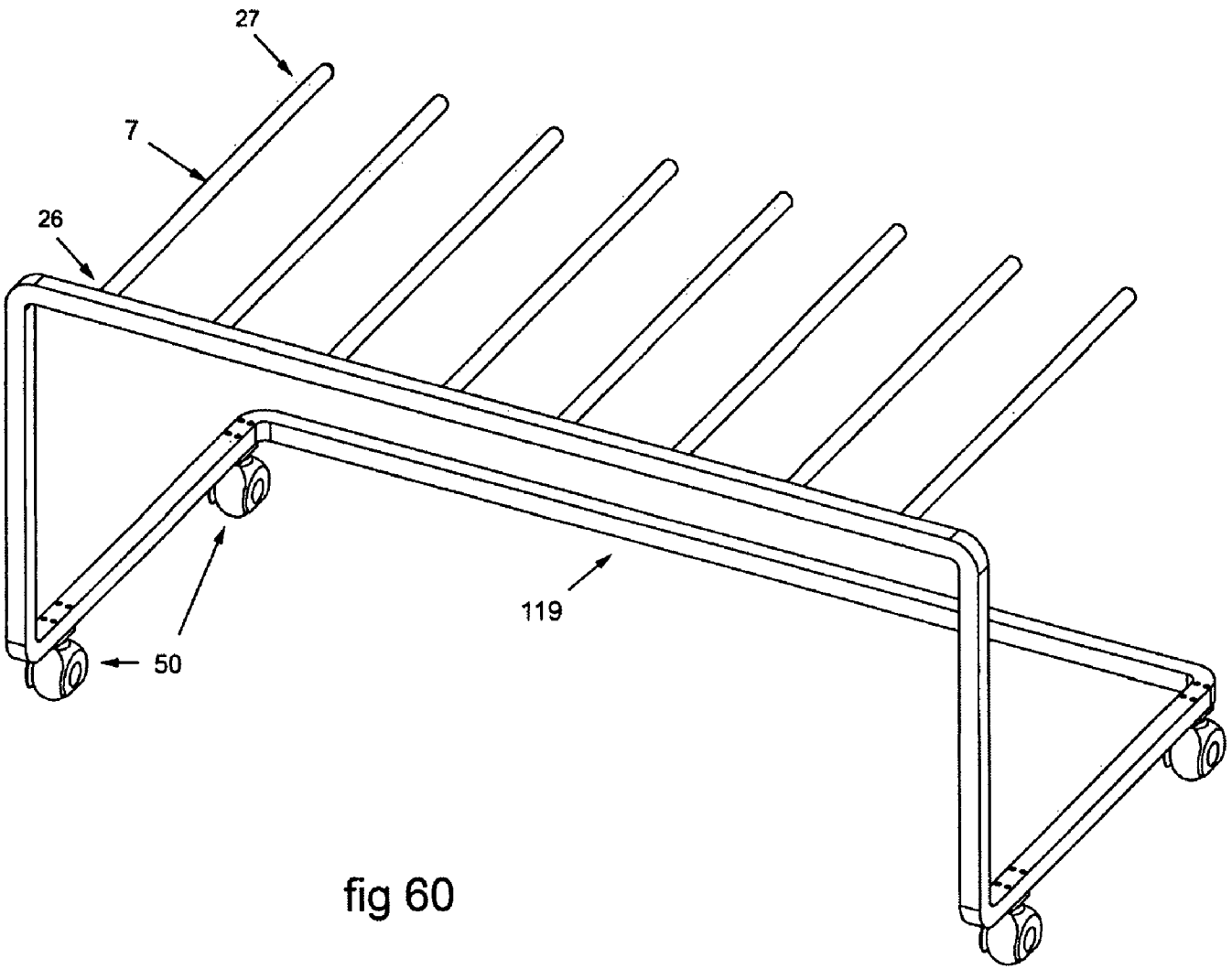
FIG. 60. Front perspective of the structure of the maneuverable bed (119)

(2) The Maneuverable Bed (FIG. 60)

The maneuverable bed of the Type C multi-purpose hospital bed is made of similar air sacs to that of the stationary bed (Please see above for detailed explanation).

The base (119) of the maneuverable bed is a strong structure made of hard durable material. There are eight rods (7) attached to the axle rod (123); each being a strong rod with one end (26) resting on the axle rod (123) while its opposite end (27) is free to enable the sliding in of each air sac. On each rod end (27), there are 3 holes (14) angled equally (120 degrees) to each other to which the metal ball (8) bearing assembly on the hole of each air sac is set to ensure the stable positioning of the air sac on the rod and to prevent unwanted movements. Four wheels (50) have been provided for the easy and convenient handling of the whole structure.

There is also a mechanical tap (71) (FIG. 37) with a pump handle that functions to route compressed air to the air tubes inside the air sacs through connecting hose number 121. This sort of control tap has an inlet hole (75) which connects the tap to the air compressor as well as two outlet holes (76 and 77). When the lever (72) is raised, compressed air enters the air sacs through outlet hole number 76 and when the lever (72) is lowered, compressed air exits the air sacs through outlet hole number 77.

Figure 62:
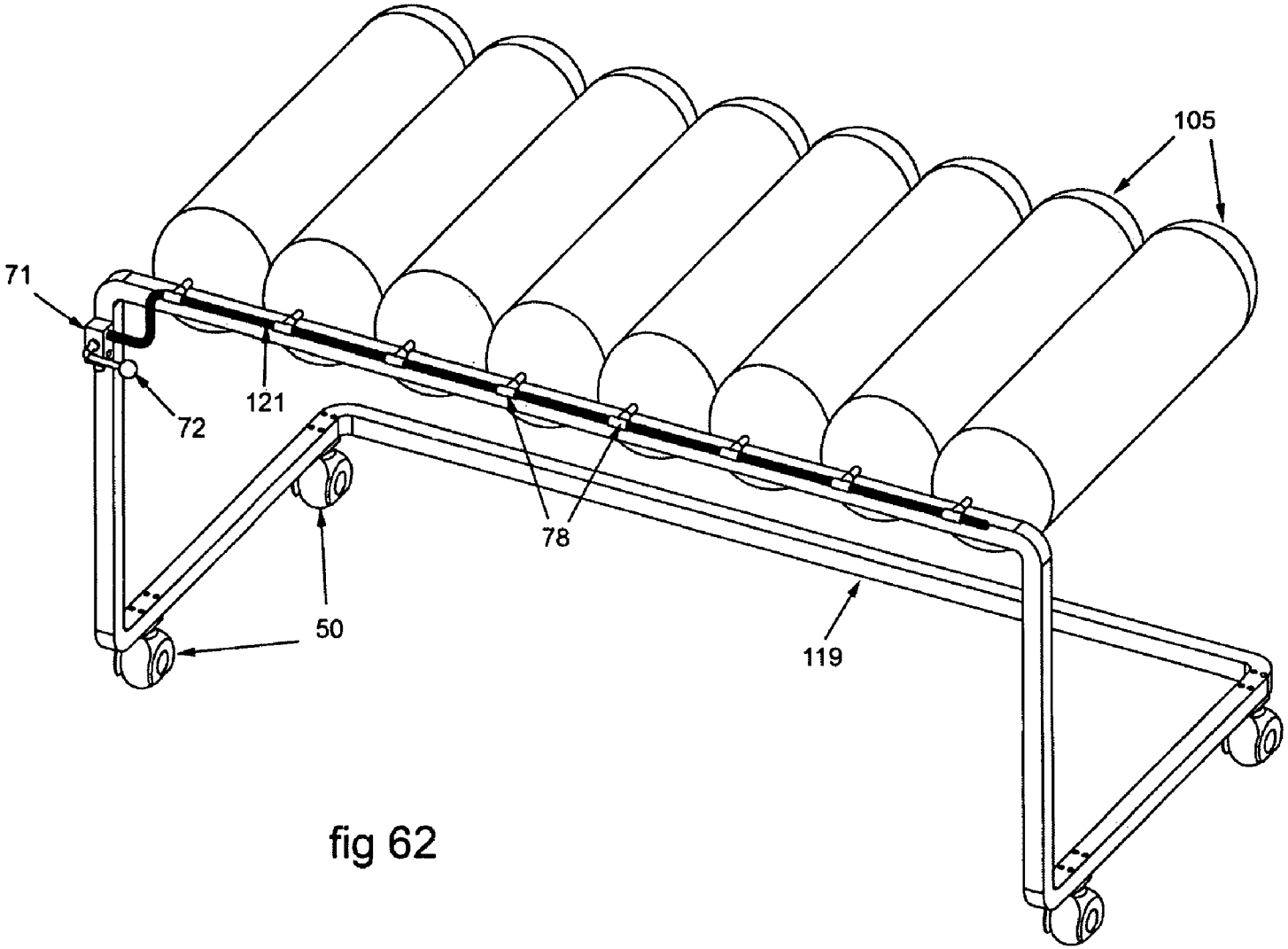
FIG. 62. Front perspective of all parts of the maneuverable bed showing the position of the control tap (71) and the connecting hose (121)
Figure 63:
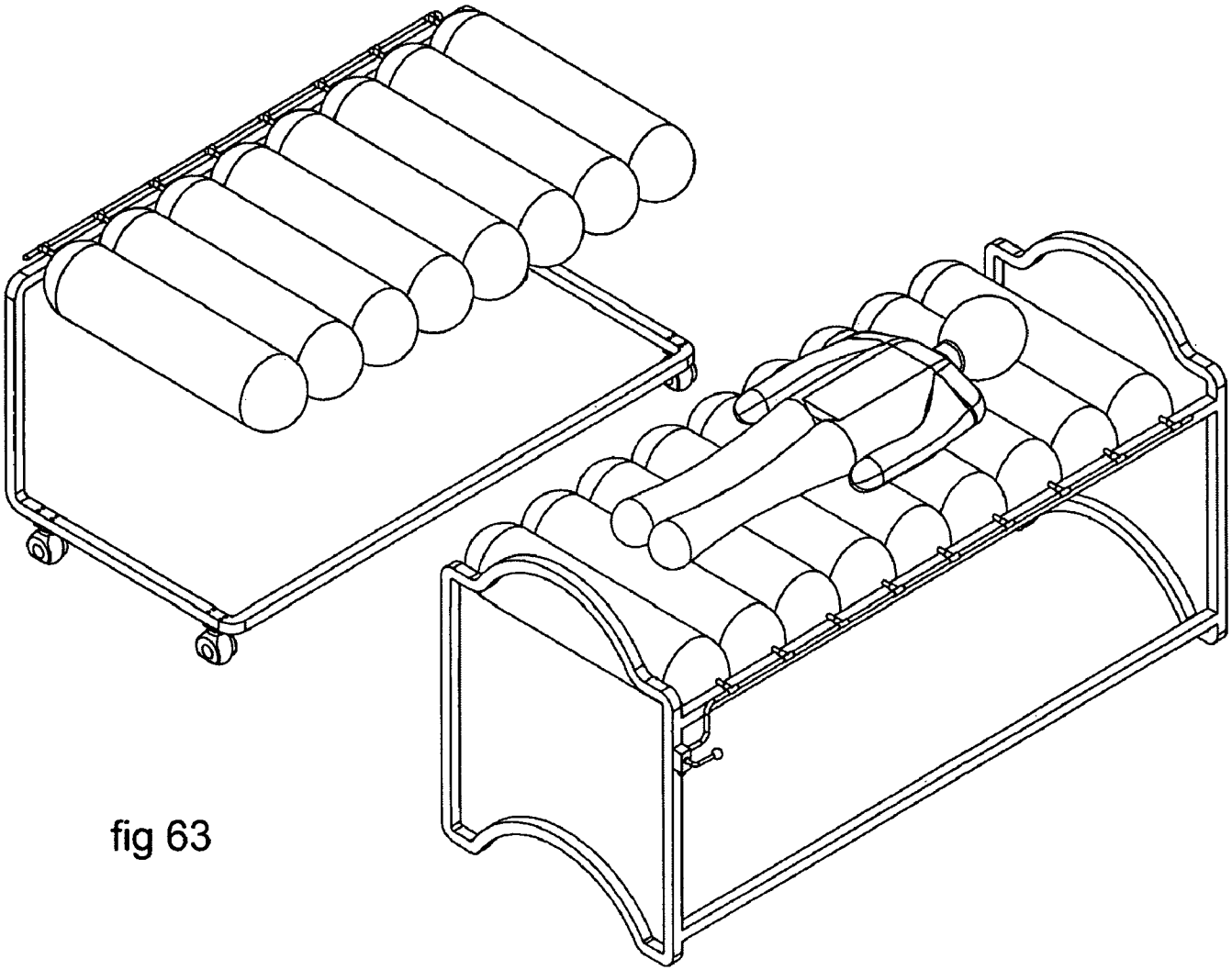
FIG. 63. Front perspective of a pictorial performance showing the transfer of a dummy patient from the stationary bed to the maneuverable one (Type C)
Figure 64:
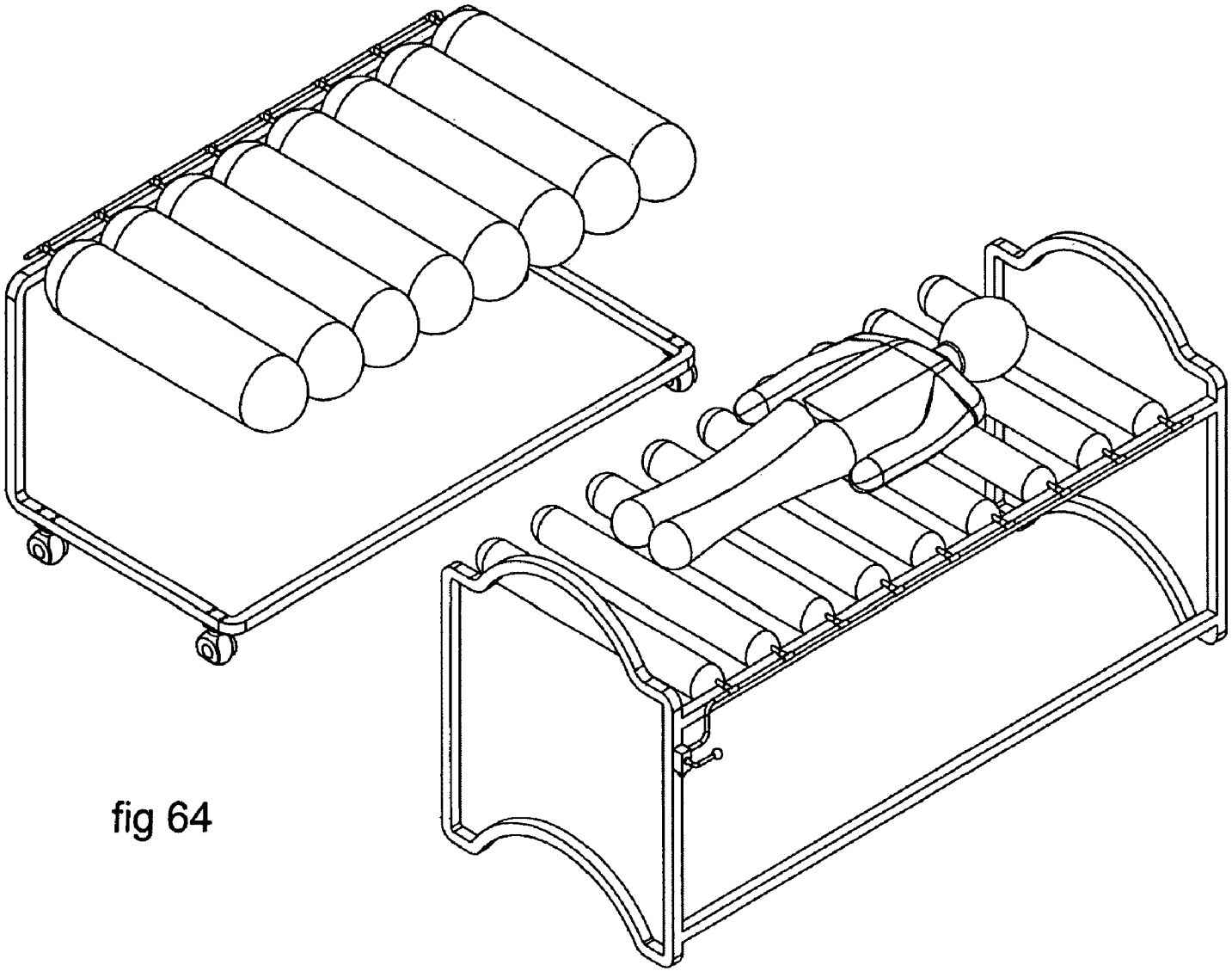
FIG. 64. Compressed air in the air sacs of the stationary bed being emptied to a required level thereby reducing their volume in half; thus, empty space is created between the air sacs of the stationary bed allowing the air sacs of the maneuverable bed to fill the empty spaces FIG. 65. Compressed air in the air sacs of the maneuverable bed being emptied to a required level thereby reducing their volume to one third of the original and thus empty space is created between the air sacs of this bed for the air sacs of the stationary bed to fill FIG. 66. The air sacs of the maneuverable bed goes into the empty spaces between the air sacs of the stationary bed without any contact incurred on the patient; and, the air sacs of the stationary bed goes into the empty spaces between the air sacs of the maneuverable bed FIG. 67. Compressed air enters the air sacs of the maneuverable bed through the control tap (71) thereby increasing their volume; meanwhile, compressed air in the air sacs of the stationary bed is completely emptied and thus the weight of the dummy patient is transferred on to the maneuverable bed from the stationary bed FIG. 68. The maneuverable bed with the dummy patient lying on it is taken away from within the stationary bed FIG. 69. Compressed air enters the air sacs of the maneuverable bed through the control tap (71) and its volume is back to the original (63)
Figure 65:
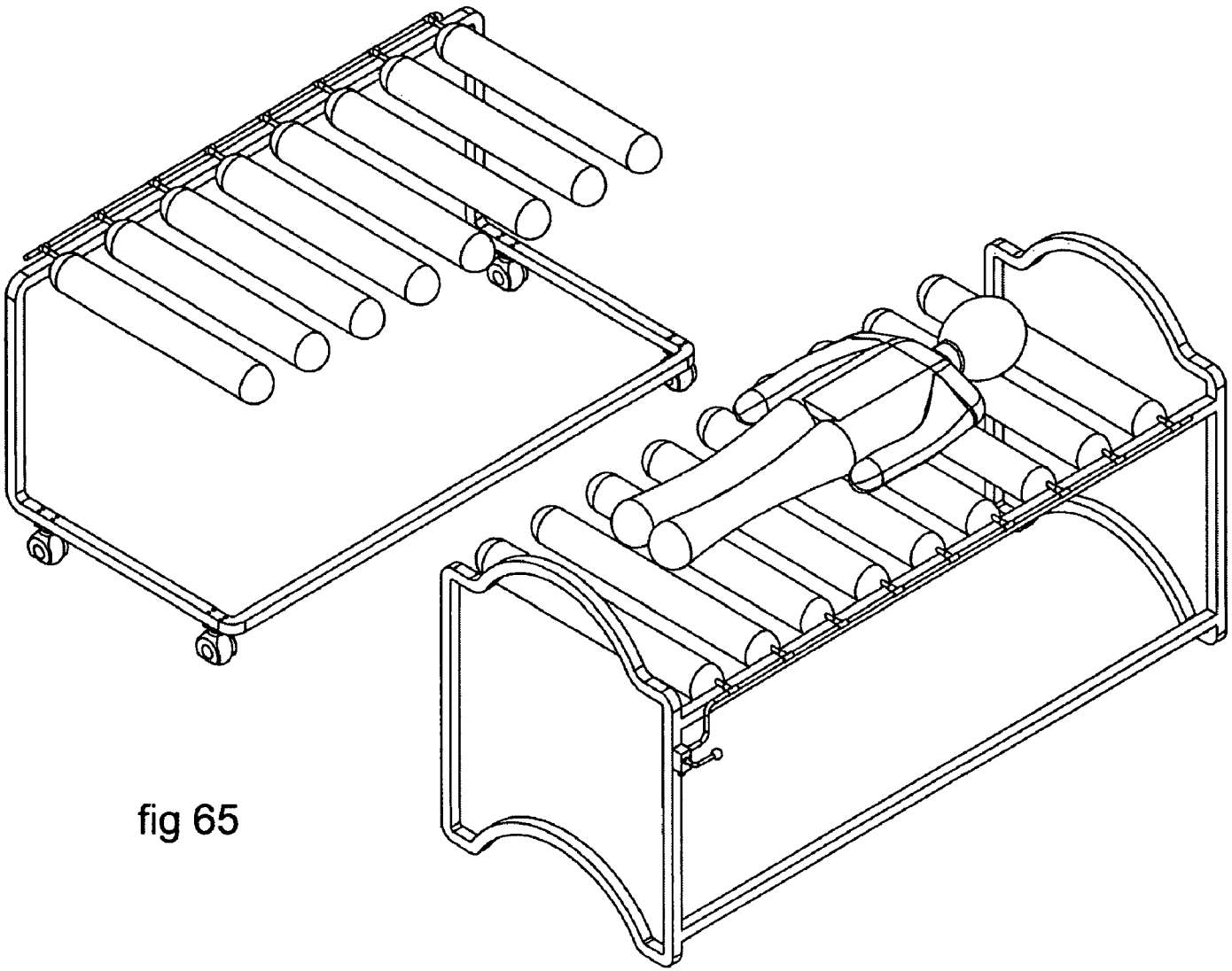
Figure 66:
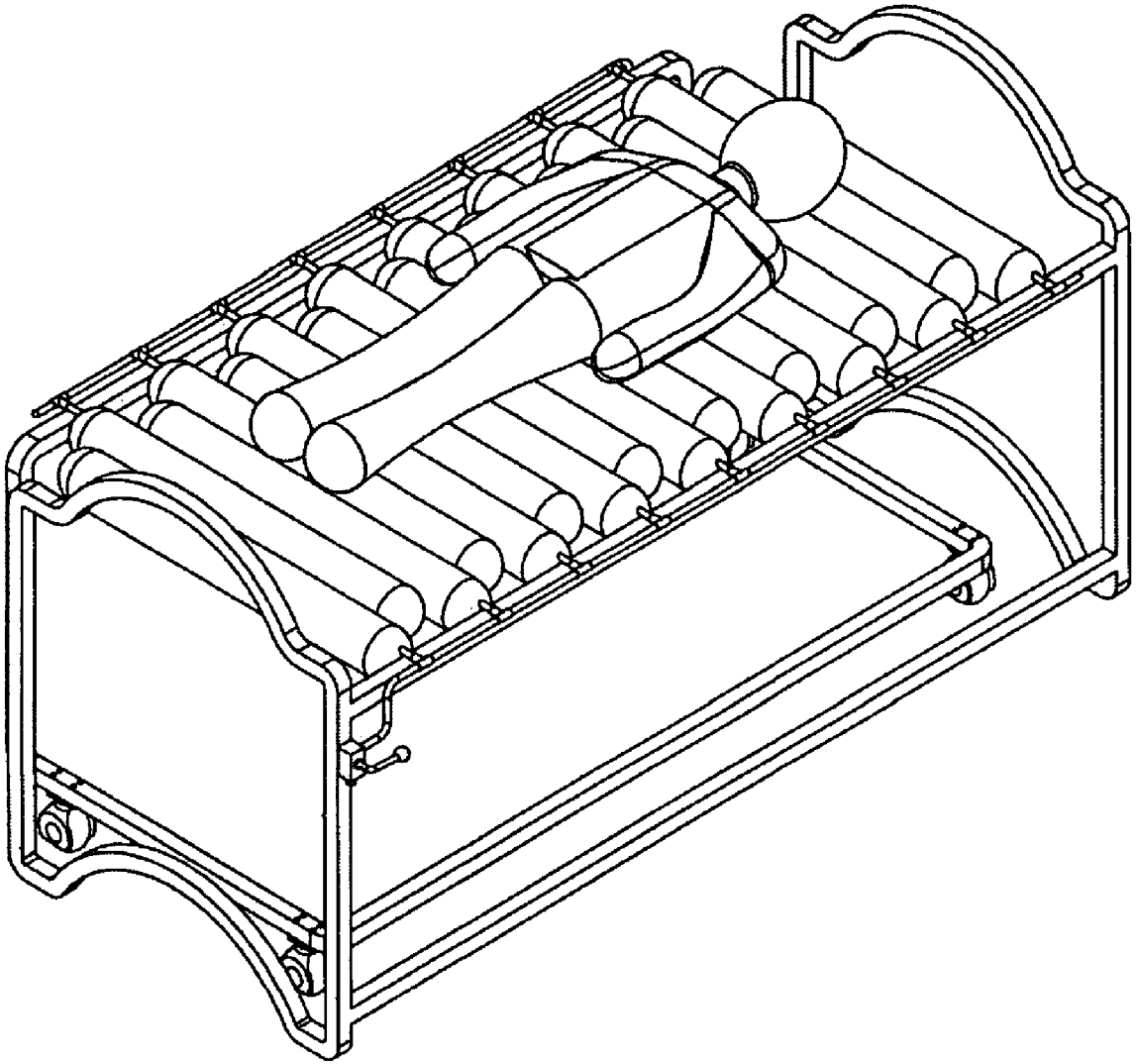
Figure 67:
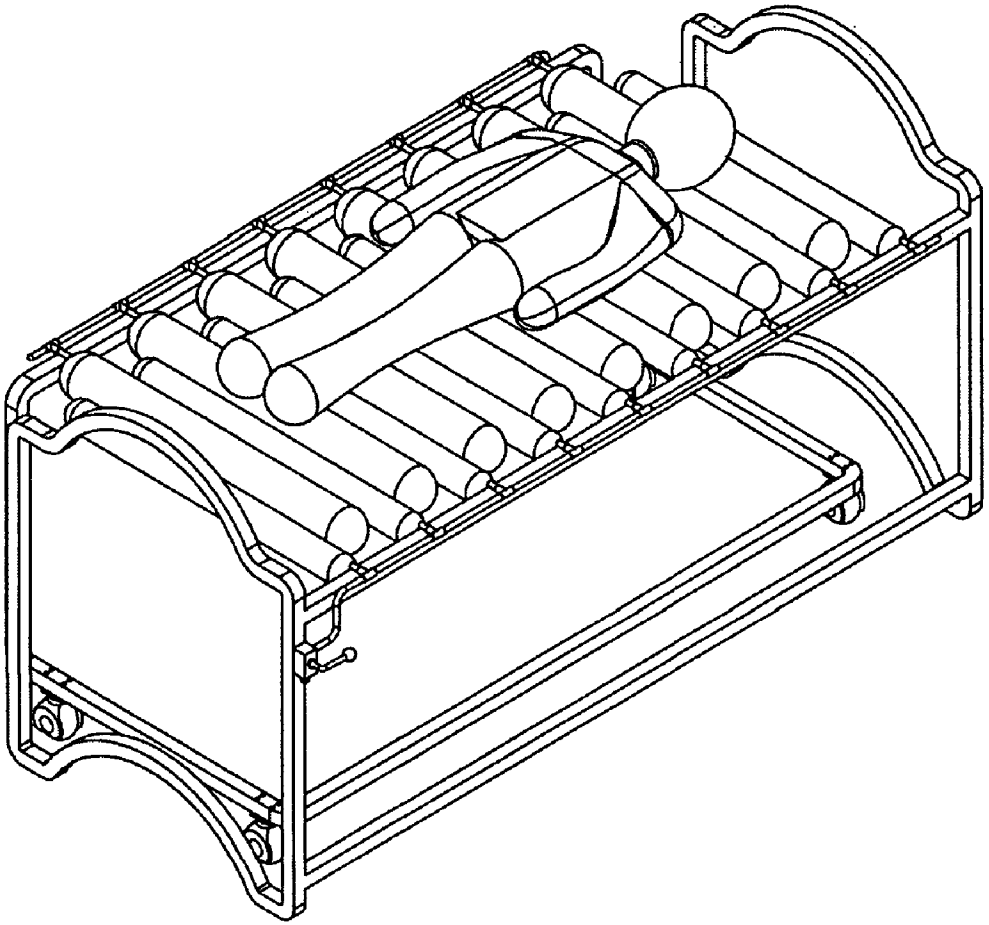
Figure 68:
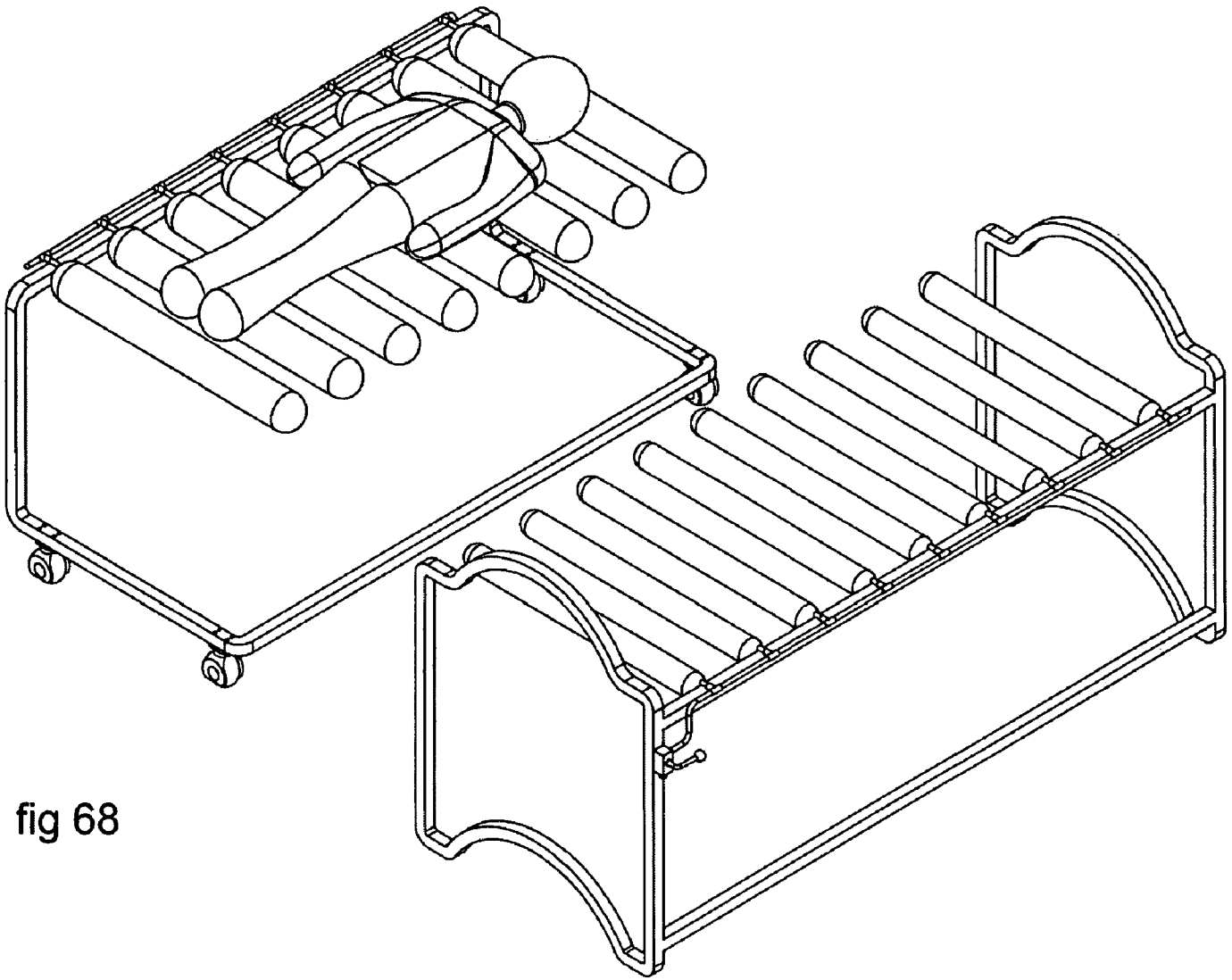
Figure 69:
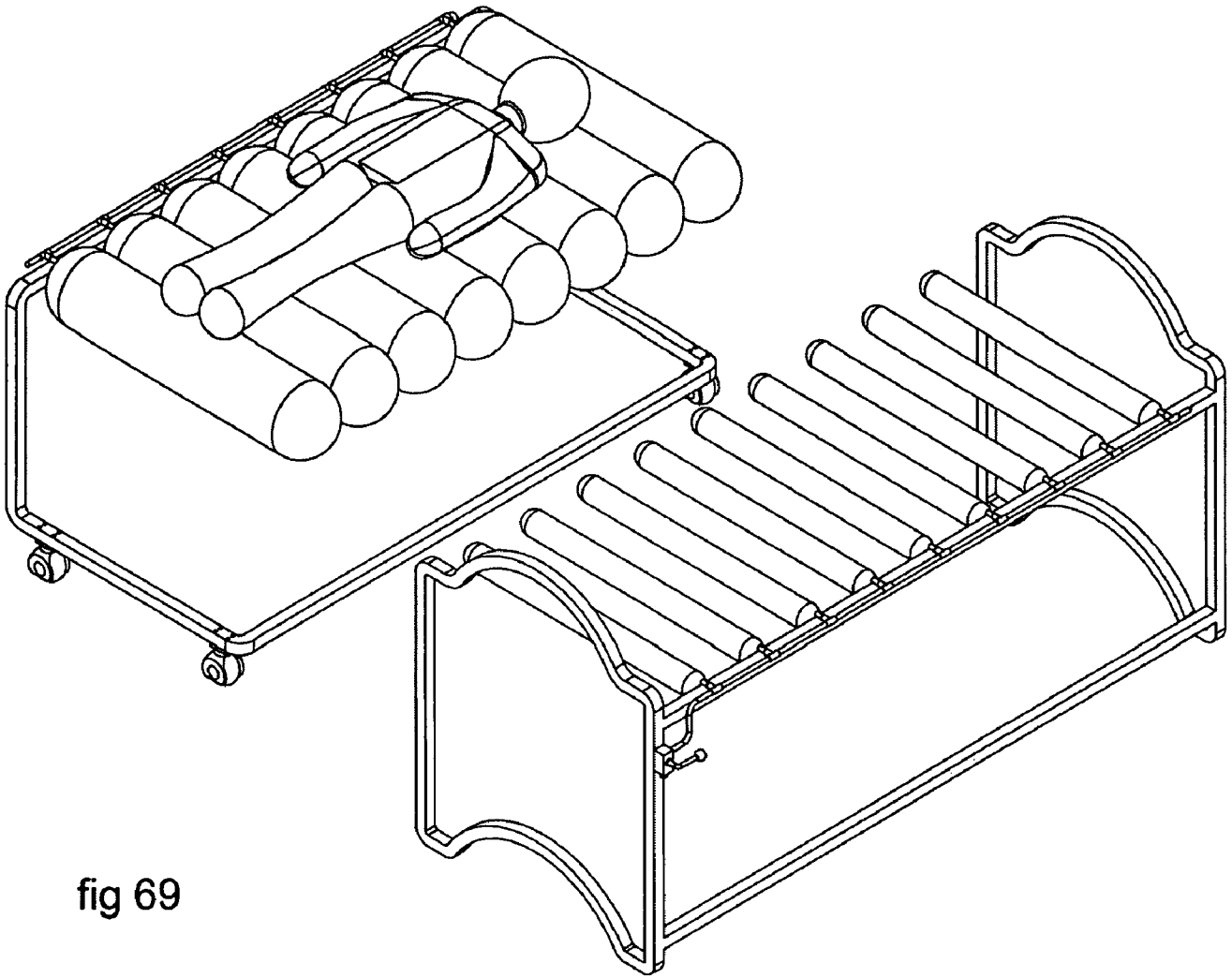

Likewise, a connecting hose (121) functions in routing compressed air from the mechanical control tap (71) to the air sacs. There are 3-way connectors provided so that air is distributed simultaneously and equally to all the air sacs (FIG. 62). For emphasis, it must be reiterated that although this invention has been described with reference to particular embodiments, it is to be understood that these embodiments are merely illustrations of the principal applications of this present invention. Numerous modifications may be made especially as to materials used and to energy supplied if transformed from a manually-operated system to a system which is energy driven. However, other arrangements devised, many of which have been mentioned here, would not depart from the scope of this present invention.

For emphasis, it must be reiterated that although this invention has been described with reference to particular embodiments, it is to be understood that these embodiments are merely illustrations of the principal applications of this present invention. Numerous modifications may be made especially as to materials used and to energy supplied if transformed from a manually-operated system to a system which is energy driven. However, other arrangements devised, many of which have been mentioned here, would not depart from the scope of this present invention.

What is claimed is:

1. A system for transferring a patient from one bed to another bed comprising:

a first bed wherein said first bed is moveable and comprises a surface for resting said patient comprising a plurality of predetermined sections;

a second bed wherein said second bed is moveable and comprises a surface for resting said patient comprising a plurality of predetermined sections;

a means for combining said surface of said first bed with said surface of said second bed by removing at least one of said plurality of predetermined sections of said surface of said first bed and replacing said at least one of said plurality of predetermined sections of said surface of said first bed with at least one of said plurality of predetermined sections of said surface of said second bed without vertical lifting movement of the first and second beds and removing at least one of said plurality of predetermined sections of said surface of said second bed and replacing said at least one of said plurality of predetermined sections of said surface of said second bed with at least one of said plurality of predetermined sections of said surface of said first bed without vertical lifting movement of the first and second beds;

wherein said pluralities of predetermined sections of said surface said first bed and said pluralities of predetermined sections of said surface of second bed have a base center provided with a central axial hole to receive a rod, a vertical hole connected to said central hole, a ball bearing assembly arranged in said vertical hole, a groove arranged over the vertical hole and a metal locking pin provided in the groove.

2. The system as claimed in claim 1, wherein said system further comprises:

a first axle rod and a second axle rod dedicate to said first bed;

a first plurality of rods wherein each of said first plurality of rods comprises a first end and a second end wherein said first end is attached to said first axle rod of said first bed;

a second plurality of rods wherein each of said second plurality of rods comprises a first end and a second end wherein said first end is attached to said second axle rod of said first bed.

3. The system as claimed in claim 2, wherein said first plurality of predetermined sections are attached to said first plurality of rods and said second plurality of predetermined sections are attached to said second plurality of rods.

4. The system as claimed in claim 1, wherein said system further comprises:

a first axle rod and a second axle rod dedicated to said second bed;

a first plurality of rods wherein each of said first plurality of rods comprises a first end and a second end wherein said first end is attached to said first axle rod of said second bed;

a second plurality of rods wherein each of said second plurality of rods comprises a first end and a second end wherein said first end is attached to said second axle rod of said second bed.

5. The system as claimed in claim 4, wherein said first plurality of predetermined sections of said first bed and of said second bed are attached to said first plurality of rods of said first bed and of said second bed respectively, and said second plurality of predetermined sections of said first bed and of said second bed are attached to said second plurality of rods of said first bed and of said second bed respectively.

6. The system as claimed in claim 1, wherein said plurality of predetermined sections comprise of at least one section selected from a group comprising of planks and air sacs.

7. The system as claimed in claim 6, wherein said planks and said air sacks are removable and comprise a base center; a first cover; and a second cover, wherein said second cover covers said first cover.

8. The system as claimed in claim 7, wherein said second cover is changeable.

9. The system as claimed in claim 7, wherein said air sack is comprised of a base center which is embraced by a plurality of small air bags wherein said small air bags are covered by said second covers.

10. The system as claimed in claim 7, wherein said system comprises a means for securing said base center to said rods.

11. The system according to claim 7, Wherein the volume of air sacks of the first bed and that of the second bed are reduced to create enough space for mixing the surface of first bed and the surface of second bed.

12. The system according to claim 7, wherein the said planks and the air sacks are rotated along the longitudinal axis to provide a new and clean resting surface for the patient.

13. The system as claimed in claim 1, wherein said system further comprises a means for lowering said plurality of predetermined sections.

14. The system as claimed in claim 1, wherein said system further comprises a means for rotating said plurality of predetermined sections.

15. The system as claimed in claim 1, wherein said system further comprises a means for rising said plurality of predetermined sections.

16. The system as claimed in claim 1, wherein said system further comprises a means for adjusting volume of said plurality of predetermined sections.

17. The system as claimed in any of claims 13, 14, 15 and 16, wherein said means is manual, pneumatic or mechanical.

18. The system according to claim 1, wherein the ball bearing assembly comprises:

a metal ball received and stored inside the vertical hole;

a metal spring arranged over the said metal ball and mounted inside the vertical hole; and a curved metal pin arranged over the metal spring and installed in the said groove.

19. A method for transferring a patient from a first bed to a second bed, wherein said patient is disposed upon said first bed and said first bed comprises a surface for resting said patient comprising a plurality of predetermined sections and said second bed comprises a surface for resting said patient comprising a plurality of predetermined sections, comprising:

removing at least one of said plurality of predetermined sections of said surface of said first bed and replacing said at least one of said plurality of predetermined sections of said surface of said first bed with at least one of said plurality of predetermined sections of said surface of said second bed without vertical lifting movement of the first and second beds and removing at least one of said plurality of predetermined sections of said surface of said second bed and replacing said at least one of said plurality of predetermined sections of said surface of said second bed with at least one of said plurality of predetermined sections of said surface of said first bed without vertical lifting movement of the first and second beds;

moving said first bed or said second bed or both said first bed and said second bed combining said surface of said first bed with said surface of said second bed; and transferring said patient from said first bed to said second bed without vertical lifting movement of the first and second beds.

20. The method as claimed in claim 19, wherein said method further comprises:

lowering said plurality of predetermined sections.

21. A method as claimed in claim 19, wherein said method further comprises:

rotating said plurality of predetermined sections.

22. A method as claimed in claim 19, wherein said method further comprises:

rising said plurality of predetermined sections.

23. A method as claimed in claim 19, wherein said method further comprises:

adjusting volume of said plurality of predetermined sections.

24. A method as claimed in any of claims 20, 21, 22 and 23, wherein said method performed manually, by means of pneumatic or mechanical.

* * * * *